US010490128B1

(12) United States Patent
Qian et al.

(10) Patent No.: US 10,490,128 B1
(45) Date of Patent: Nov. 26, 2019

(54) ELECTRONIC DEVICES HAVING LOW REFRESH RATE DISPLAY PIXELS WITH REDUCED SENSITIVITY TO OXIDE TRANSISTOR THRESHOLD VOLTAGE

(71) Applicant: Apple Inc., Cupertino, CA (US)

(72) Inventors: Chuang Qian, Santa Clara, CA (US); Tsung-Ting Tsai, Cupertino, CA (US); Cheng-Chih Hsieh, Santa Clara, CA (US); Shyuan Yang, Burlingame, CA (US); Ting-Kuo Chang, San Jose, CA (US); Abbas Jamshidi Roudbari, San Jose, CA (US); Shih Chang Chang, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/255,691

(22) Filed: Jan. 23, 2019

Related U.S. Application Data

(63) Continuation of application No. 16/125,449, filed on Sep. 7, 2018, now abandoned.

(60) Provisional application No. 62/680,911, filed on Jun. 5, 2018.

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0819* (2013.01); *G09G 2300/0871* (2013.01); *G09G 2310/08* (2013.01); *G09G 2320/0233* (2013.01);
(Continued)

(58) Field of Classification Search
CPC ..... G09G 3/3233; G09G 3/3266; G09G 2300/0819; G09G 2300/0871; G09G 2310/08; G09G 2320/0233; G09G 2320/0242; G09G 2320/045; G09G 2320/064
See application file for complete search history.

(56) References Cited

U.S. PATENT DOCUMENTS 7,688,292 B2 3/2010 Park et al.
8,390,653 B2 3/2013 Miwa
9,490,276 B2 11/2016 Kim et al.
(Continued)

*Primary Examiner* — Peter D McLoone
(74) *Attorney, Agent, or Firm* — Treyz Law Group; Jason Tsai

(57) ABSTRACT

A display may have an array of organic light-emitting diode display pixels operating at a low refresh rate. Each display pixel may include a drive transistor coupled in series with one or more emission transistors and a respective organic light-emitting diode (OLED). A semiconducting-oxide transistor may be coupled between a drain terminal and a gate terminal of the drive transistor to help reduce leakage during low-refresh-rate display operations. A silicon transistor may be further interposed between the semiconducting-oxide transistor and the gate terminal of the drive transistor. One or more capacitor structures may be coupled to the source terminal and/or the drain terminal of the semiconducting-oxide transistor to reduce rebalancing current that might flow through the semiconducting-oxide transistor as it is turned off. Configured in this way, any emission current flowing through the OLED will be insensitive to any potential drift in the threshold voltage of the semiconducting-oxide transistor.

26 Claims, 19 Drawing Sheets

(52) U.S. Cl.
CPC ..... *G09G 2320/0242* (2013.01); *G09G 2320/045* (2013.01); *G09G 2320/064* (2013.01)

(56) References Cited

U.S. PATENT DOCUMENTS

| | | | | |
|---|---|---|---|---|
| 2014/0320544 | A1* | 10/2014 | Kim | G09G 3/3233 345/690 |
| 2016/0240565 | A1* | 8/2016 | Kim | H01L 27/1251 |
| 2018/0226018 | A1 | 8/2018 | Han | |

* cited by examiner

ELECTRONIC DEVICES HAVING LOW REFRESH RATE DISPLAY PIXELS WITH REDUCED SENSITIVITY TO OXIDE TRANSISTOR THRESHOLD VOLTAGE

This application is a continuation of application Ser. No. 16/125,449, filed Sep. 7, 2018, which claims the benefit of provisional patent application Ser. No. 62/680,911, filed on Jun. 5, 2018, which are hereby incorporated by reference herein in their entireties.

Field

This relates generally to electronic devices and, more particularly, to electronic devices with displays.

Background

Electronic devices often include displays. For example, cellular telephones and portable computers include displays for presenting information to users.

Displays such as organic light-emitting diode displays have an array of display pixels based on light-emitting diodes. In this type of display, each display pixel includes a light-emitting diode and thin-film transistors for controlling application of a signal to the light-emitting diode to produce light.

For instance, a display pixel often includes a drive thin-film transistor that controls the amount of current flowing through the light-emitting diode and a switching transistor directly connected to the gate terminal of the drive thin-film transistor. The switching transistor is implemented as a semiconducting-oxide transistor, which typically exhibits low leakage when the switching transistor is turned off. This low-leakage property of the semiconducting-oxide switching transistor helps to keep the voltage at the gate terminal of the drive thin-film transistor relatively constant during a given emission period of the display pixel when the drive thin-film transistor passes current to the light-emitting diode to produce light.

The semiconducting-oxide switching transistor, however, exhibits reliability issues over the lifetime of the display. In particular, the semiconducting-oxide transistor has a threshold voltage that drifts overtime as the semiconducting-oxide transistor is repeatedly turned on and off. As the threshold voltage of the semiconducting-oxide transistor changes, the voltage at the gate terminal of the drive thin-film transistor immediately prior to emission will also be affected. This directly impacts the amount of current flowing through the light-emitting diode, which controls the amount of light or luminance produced by the display pixel. This sensitivity of the light-emitting diode current to the threshold voltage of the semiconducting-oxide switching transistor increases the risk of non-ideal display behaviors such as luminance non-uniformity across the display, luminance drop over the lifetime of the display, undesired color shifts over the lifetime of the display (e.g., resulting in a cyan/greenish tint on the display), etc.

Summary

An electronic device may include a display having an array of display pixels. The display pixels may be organic light-emitting diode display pixels. Each display pixel may include a light-emitting diode, a drive transistor coupled in series with the light-emitting diode, a transistor of a first semiconductor type (e.g., a semiconducting-oxide thin-film transistor) coupled between the drain terminal and the gate terminal of the drive transistor, a transistor of a second semiconductor type (e.g., a silicon thin-film transistor such as a low-temperature polysilicon transistor) interposed between the transistor of the first semiconductor type and the gate terminal of the drive transistor, a first emission transistor coupled in series with the drive transistor and the light-emitting diode, a second emission transistor coupled in series with the drive transistor and the power line, an initialization transistor coupled directly to the light-emitting diode, and a data loading transistor coupled directly to the source terminal of the drive transistor. In particular, the semiconducting-oxide transistor may be configured to reduce leakage at the gate terminal of the drive transistor, and the silicon transistor may be configured to reduce the sensitivity of an emission current that flows through the light-emitting diode to the threshold voltage of the semiconducting-oxide transistor.

Each display pixel may further include a storage capacitor coupled to the gate terminal of the drive transistor (e.g., a storage capacitor configured to store a data signal for the display pixel) and a matching capacitor directly coupled to either the source terminal or the drain terminal of the semiconducting-oxide transistor. The matching capacitor may be configured to reduce a rebalancing current that flows through the semiconducting-oxide transistor as it is turned off. The matching capacitor may generally be substantially smaller than the storage capacitor (e.g., the matching capacitor may be at least two times smaller than the storage capacitor, at least four times smaller, at least eight times smaller, at least 10 times smaller, 2-10 times smaller, 10-20 times smaller, 20-100 times smaller, 100-1000 times smaller, or more than 1000 times smaller than the storage capacitor).

In one suitable arrangement, the semiconducting-oxide transistor has a gate terminal configured to receive a scan control signal, whereas the silicon transistor has a gate terminal configured to receive an emission control signal that is different than the scan control signal. In another suitable arrangement, the semiconducting-oxide transistor and the silicon transistor have gate terminals configured to receive the same scan control signal. The threshold voltage of the silicon transistor may be greater than the threshold voltage of the semiconducting-oxide transistor to ensure that the silicon transistor is turned off before the semiconducting-oxide transistor is turned off at the falling edge of the scan control signal. Configured and operated in this way, the electronic device will exhibit luminance uniformity across the display, reduced luminance drop over the lifetime of the display, and reduced color shift over the lifespan of the display.

In accordance with another suitable arrangement, a display may be controlled using a pulse width modulation (PWM) scheme that modulates the luminance of the display. The duty cycle of the PWM scheme may be increased once every 100-1000 hours to compensate for the any luminance drop for the display.

In accordance with yet another suitable arrangement, the scan control signal that controls the semiconducting-oxide transistor may be adapted to changes in the threshold voltage of the semiconducting oxide transistor to compensate for any luminance drop in the display. As an example, the high voltage level of the scan control signal may be decreased by 30-70 mV once every at least 300 hours to help maintain the luminance of the display at the intended level. As another example, the low voltage level of the scan control signal may be increased by 30-70 mV once every at least 300 hours to help maintain the luminance of the display at the desired level.

DETAILED DESCRIPTION

Figure 1:
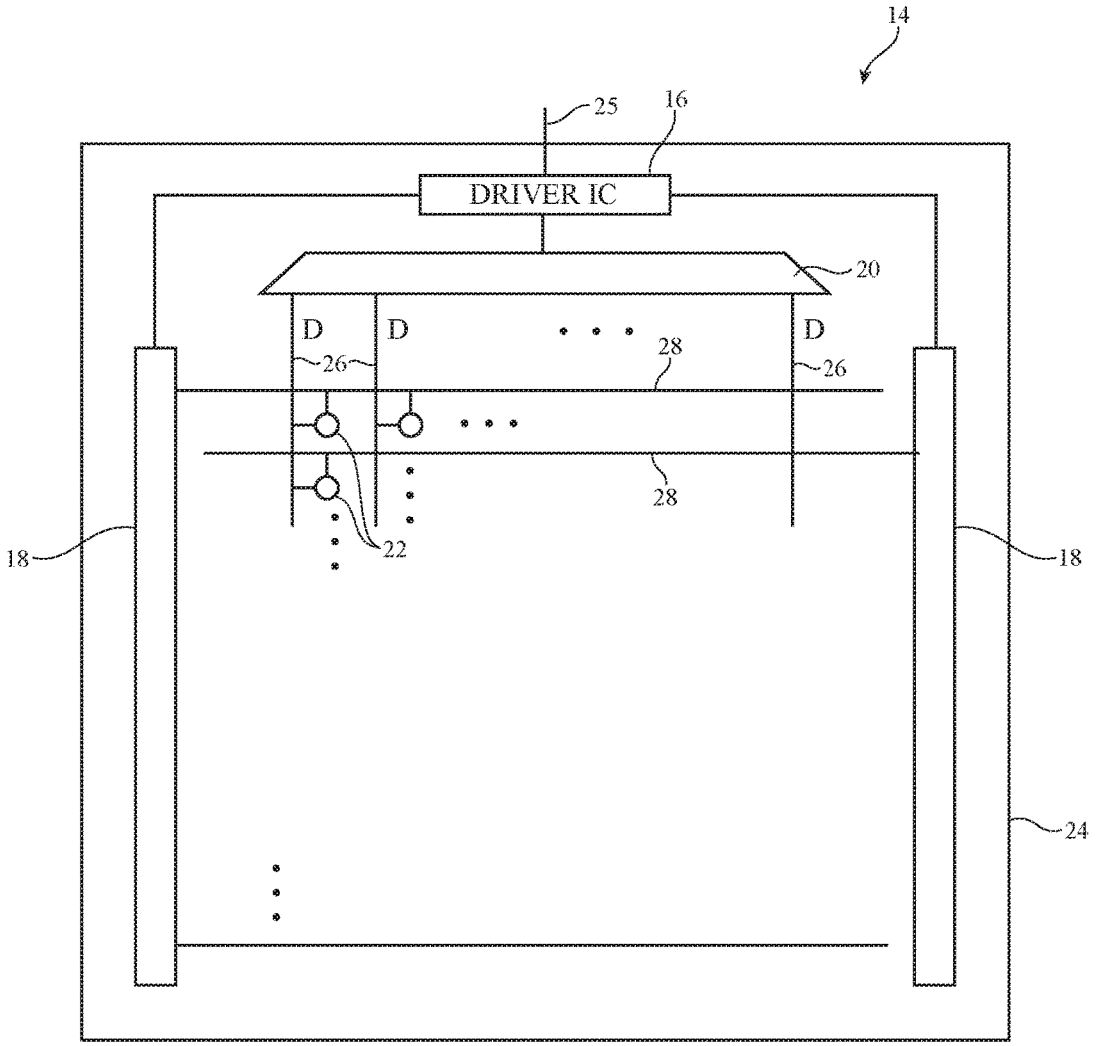
FIG. 1 is a diagram of an illustrative display such as an organic light-emitting diode display having an array of organic light-emitting diode (OLED) display pixels in accordance with an embodiment.

A display in an electronic device may be provided with driver circuitry for displaying images on an array of display pixels. An illustrative display is shown in FIG. 1. As shown in FIG. 1, display 14 may have one or more layers such as substrate 24. Layers such as substrate 24 may be formed from planar rectangular layers of material such as planar glass layers. Display 14 may have an array of display pixels 22 for displaying images for a user. The array of display pixels 22 may be formed from rows and columns of display pixel structures on substrate 24. These structures may include thin-film transistors such as polysilicon thin-film transistors, semiconducting oxide thin-film transistors, etc. There may be any suitable number of rows and columns in the array of display pixels 22 (e.g., ten or more, one hundred or more, or one thousand or more).

Display driver circuitry such as display driver integrated circuit 16 may be coupled to conductive paths such as metal traces on substrate 24 using solder or conductive adhesive. Display driver integrated circuit 16 (sometimes referred to as a timing controller chip) may contain communications circuitry for communicating with system control circuitry over path 25. Path 25 may be formed from traces on a flexible printed circuit or other cable. The system control circuitry may be located on a main logic board in an electronic device such as a cellular telephone, computer, computer tablet, television, set-top box, media player, wrist watch, portable electronic device, or other electronic equipment in which display 14 is being used. During operation, the system control circuitry may supply display driver integrated circuit 16 with information on images to be displayed on display 14 via path 25. To display the images on display pixels 22, display driver integrated circuit 16 may supply clock signals and other control signals to display driver circuitry such as row driver circuitry 18 and column driver circuitry 20. Row driver circuitry 18 and/or column driver circuitry 20 may be formed from one or more integrated circuits and/or one or more thin-film transistor circuits on substrate 24.

Row driver circuitry 18 may be located on the left and right edges of display 14, on only a single edge of display 14, or elsewhere in display 14. During operation, row driver circuitry 18 may provide row control signals on horizontal lines 28 (sometimes referred to as row lines or "scan" lines). Row driver circuitry 18 may therefore sometimes be referred to as scan line driver circuitry. Row driver circuitry 18 may also be used to provide other row control signals such as emission control lines, if desired.

Column driver circuitry 20 may be used to provide data signals D from display driver integrated circuit 16 onto a plurality of corresponding vertical lines 26. Column driver circuitry 20 may sometimes be referred to as data line driver circuitry or source driver circuitry. Vertical lines 26 are sometimes referred to as data lines. During compensation operations, column driver circuitry 20 may use paths such as vertical lines 26 to supply a reference voltage. During programming operations, display data is loaded into display pixels 22 using lines 26.

Each data line 26 is associated with a respective column of display pixels 22. Sets of horizontal signal lines 28 run horizontally through display 14. Power supply paths and other lines may also supply signals to pixels 22. Each set of horizontal signal lines 28 is associated with a respective row of display pixels 22. The number of horizontal signal lines in each row may be determined by the number of transistors in the display pixels 22 that are being controlled independently by the horizontal signal lines. Display pixels of different configurations may be operated by different numbers of control lines, data lines, power supply lines, etc.

Row driver circuitry 18 may assert control signals on the row lines 28 in display 14. For example, driver circuitry 18 may receive clock signals and other control signals from display driver integrated circuit 16 and may, in response to the received signals, assert control signals in each row of display pixels 22. Rows of display pixels 22 may be processed in sequence, with processing for each frame of image data starting at the top of the array of display pixels and ending at the bottom of the array (as an example). While the scan lines in a row are being asserted, the control signals and data signals that are provided to column driver circuitry 20 by circuitry 16 direct circuitry 20 to demultiplex and drive associated data signals D onto data lines 26 so that the display pixels in the row will be programmed with the display data appearing on the data lines D. The display pixels can then display the loaded display data.

In an organic light-emitting diode (OLED) display such as display 14, each display pixel contains a respective organic light-emitting diode for emitting light. A drive transistor controls the amount of light output from the organic light-emitting diode. Control circuitry in the display pixel is configured to perform threshold voltage compensation operations so that the strength of the output signal from the organic light-emitting diode is proportional to the size of the data signal loaded into the display pixel while being independent of the threshold voltage of the drive transistor.

Figure 2:
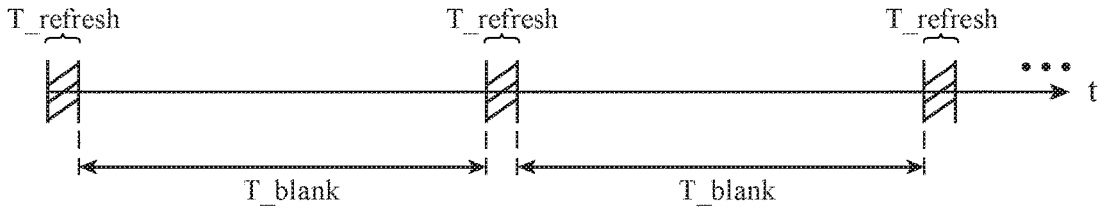
FIG. 2 is a diagram of a low refresh rate display driving scheme in accordance with an embodiment.

Display 14 may be configured to support low refresh rate operation. Operating display 14 using a relatively low refresh rate (e.g., a refresh rate of 1 Hz, 2 Hz, 1-10 Hz, less than 100 Hz, less than 60 Hz, less than 30 Hz, less than 10 Hz, less than 5 Hz, less than 1 Hz, or other suitably low rate) may be suitable for applications outputting content that is static or nearly static and/or for applications that require minimal power consumption. FIG. 2 is a diagram of a low refresh rate display driving scheme in accordance with an embodiment. As shown in FIG. 2, display 14 may alternate between a short data refresh phase (as indicated by period T_refresh) and an extended blanking period T_blank. During period T_refresh, the data value in each display pixel may be refreshed, "repainted," or updated.

As an example, each data refresh period T_refresh may be approximately 16.67 milliseconds (ms) in accordance with a 60 Hz data refresh operation, whereas each period T_blank may be approximately 1 second so that the overall refresh rate of display 14 is lowered to 1 Hz (as an example of a low refresh rate display operation). Configured as such, the duration of T_blank can be adjusted to tune the overall refresh rate of display 14. For example, if the duration of T_blank is tuned to half a second, the overall refresh rate would be increased to 2 Hz. As another example, if the duration of T_blank was tuned to a quarter of a second, the overall refresh rate would be increased to 4 Hz. In the embodiments described herein, the blanking interval T_blank may be at least two times the duration of T_refresh, at least 10 times the duration of T_refresh, at least 20 times the duration of T_refresh, at least 30 times the duration of T_refresh, at least 60 times the duration of T_refresh, 2-100 times the duration of T_refresh, more than 100 times the duration of T_refresh, etc.

Figure 3A:
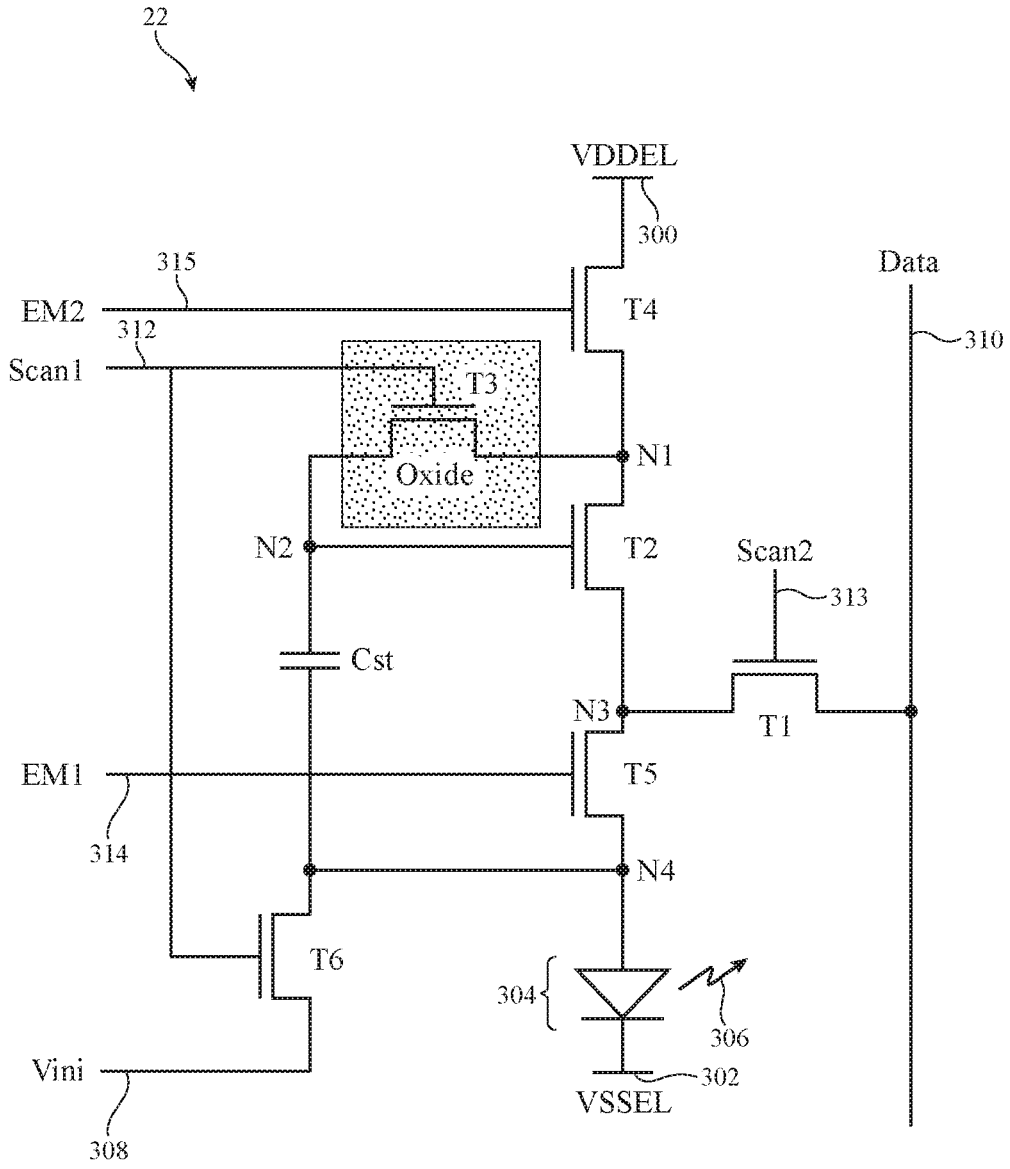
FIG. 3A is a circuit diagram of an organic light-emitting diode display pixel configured to produce an emission current that is sensitive to oxide transistor threshold voltage.

A schematic diagram of an illustrative organic light-emitting diode display pixel 22 in display 14 that can be used to support low refresh rate operation is shown in FIG. 3A. As shown in FIG. 3A, display pixel 22 may include a storage capacitor Cst and transistors such as n-type (i.e., n-channel) transistors T1, T2, T2, T3, T4, T5, and T6. The transistors of pixel 22 may be thin-film transistors formed from a semiconductor such as silicon (e.g., polysilicon deposited using a low temperature process, sometimes referred to as LTPS or low-temperature polysilicon), semiconducting oxide (e.g., indium gallium zinc oxide (IGZO)), or other suitable semiconductor material. In other words, the active region and/or the channel region of these thin-film transistors may be formed from polysilicon or semi-conducting oxide material.

Display pixel 22 may include light-emitting diode 304. A positive power supply voltage VDDEL (e.g., 1 V, 2 V, more than 1 V, 0.5 to 5 V, 1 to 10 V, or other suitable positive voltage) may be supplied to positive power supply terminal 300 and a ground power supply voltage VSSEL (e.g., 0 V, −1 V, −2 V, or other suitable negative voltage) may be supplied to ground power supply terminal 302. The state of transistor T2 controls the amount of current flowing from terminal 300 to terminal 302 through diode 304 and therefore controls the amount of emitted light 306 from display pixel 22. Transistor T2 is therefore sometimes referred to as the "drive transistor." Diode 304 may have an associated parasitic capacitance $C_{OLED}$ (not shown).

Terminal 308 is used to supply an initialization voltage Vini (e.g., a positive voltage such as 1 V, 2 V, less than 1 V, 1 to 5 V, or other suitable voltage) to assist in turning off diode 304 when diode 304 is not in use. Control signals from display driver circuitry such as row driver circuitry 18 of FIG. 1 are supplied to control terminals such as terminals 312, 313, 314, and 315. Terminals 312 and 313 may serve respectively as first and second scan control terminals, whereas terminals 314 and 315 may serve respectively as first and second emission control terminals. Scan control signals Scan1 and Scan2 may be applied to scan terminals 312 and 313, respectively. Emission control signals EM1 and EM2 may be supplied to terminals 314 and 315, respectively. A data input terminal such as data signal terminal 310 is coupled to a respective data line 26 of FIG. 1 for receiving image data for display pixel 22.

Transistors T4, T2, T5, and diode 304 may be coupled in series between power supply terminals 300 and 302. In particular, transistor T4 has a drain terminal that is coupled to positive power supply terminal 300, a gate terminal that receives emission control signal EM2, and a source terminal (labeled as node N1) coupled to transistors T2 and T3. The terms "source" and "drain" terminals of a transistor can sometimes be used interchangeably. Drive transistor T2 has a drain terminal that is coupled to node N1, a gate terminal coupled to node N2, and a source terminal coupled to node N3. Transistor T5 has a drain terminal that is coupled to node N3, a gate terminal that receives emission control signal EM1, and a source terminal coupled to node N4. Node N4 is coupled to ground power supply terminal 302 via organic light-emitting diode 304.

Transistor T3, capacitor Cst, and transistor T6 are coupled in series between node N1 and terminal 308. In particular, transistor T3 has a drain terminal that is coupled to node N1, a gate terminal that receives scan control signal Scan1 from scan line 312, and a source terminal that is coupled to node N2. Storage capacitor Cst has a first terminal that is coupled to node N2 and a second terminal that is coupled to node N4. Transistor T6 has a drain terminal that is coupled to node N4, a gate terminal that receives scan control signal Scan1 via scan line 312, and a source terminal that receives initialization voltage Vini via terminal 308.

Transistor T1 has a drain terminal that receives a data signal via data line 310, a gate terminal that receives scan control signal Scan2 via scan line 313, and a source terminal that is coupled to node N3. Connected in this way, emission control signal EM2 may be asserted to enable transistor T4 (e.g., signal EM2 may be driven to a high voltage level to turn on transistor T4); emission control signal EM1 may be asserted to activate transistor T5; scan control signal Scan2 may be asserted to turn on transistor T1; and scan control signal Scan1 may be asserted to simultaneously switch on transistors T3 and T6. Transistors T4 and T5 may sometimes be referred to as emission transistors. Transistor T6 may sometimes be referred to as an initialization transistor. Transistor T1 may sometimes be referred to as a data loading transistor.

In one suitable arrangement, transistor T3 may be implemented as a semiconducting-oxide transistor while remaining transistors T1, T2, and T4-T6 are silicon transistors. Semiconducting-oxide transistors exhibit relatively lower leakage than silicon transistors, so implementing transistor T3 as a semiconducting-oxide transistor will help reduce flicker at low refresh rates (e.g., by preventing current from leaking through T3 when signal Scan1 is deasserted or driven low).

Figure 4:
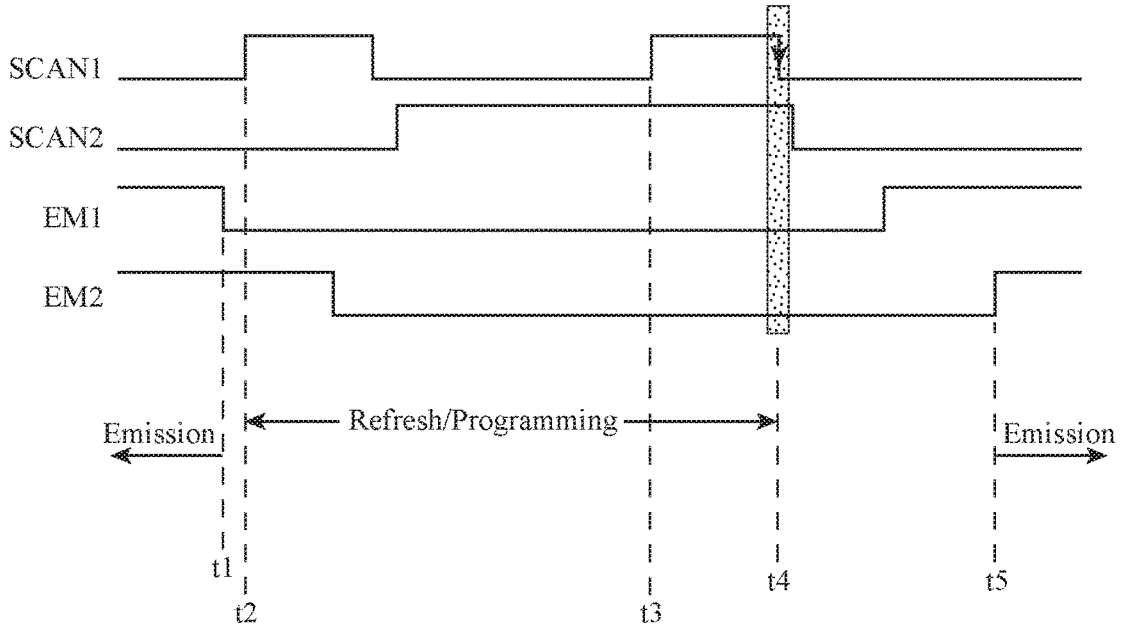
FIG. 4 is a timing diagram that illustrates the operation of the organic light-emitting diode display pixel shown in FIG. 3A.

FIG. 4 is a timing diagram that illustrates the operation of organic light-emitting diode display pixel 22 shown in FIG. 3A. Prior to time t1, signals Scan1 and Scan2 are deasserted (e.g., the scan control signals are both at low voltage levels), whereas signals EM1 and EM2 are asserted (e.g., the emission control signals are both at high voltage levels). When both emission control signals EM1 and EM2 are high, an emission current will flow through drive transistor T2 into the corresponding organic light-emitting diode 304 to produce light 306 (see FIG. 3A). The emission current is sometimes referred to as the OLED current or OLED emission current, and the period during which the OLED current is actively producing light at diode 304 is referred to as the emission phase.

At time t1, emission control signal EM1 is deasserted (i.e., driven low) to temporarily suspend the emission phase, which begins a data refresh or data programming phase. At time t2, signal Scan1 may be pulsed high to activate transistors T3 and T6, which initializes the voltage across capacitor Cst to a predetermined voltage difference (e.g., VDDEL minus Vini).

At time t3, scan control signal Scan1 is pulsed high while signal Scan2 is asserted and while signals EM1 and EM2 are both deasserted to load a desired data signal from data line 310 into display pixel 22. At time t4, scan control signal Scan1 is deasserted (e.g., driven low), which signifies the end of the data programming phase. The falling edge of signal Scan1 at time t4 may be a critical event since any unintended parasitic effects associated with the deactivation of transistor T3 will impact the voltage at node N2, which will directly affect the active OLED current and therefore the resulting luminance produced by pixel 22 in the corresponding emission phase (e.g., at time t5 when the emission control signals are reasserted).

Figure 3B:
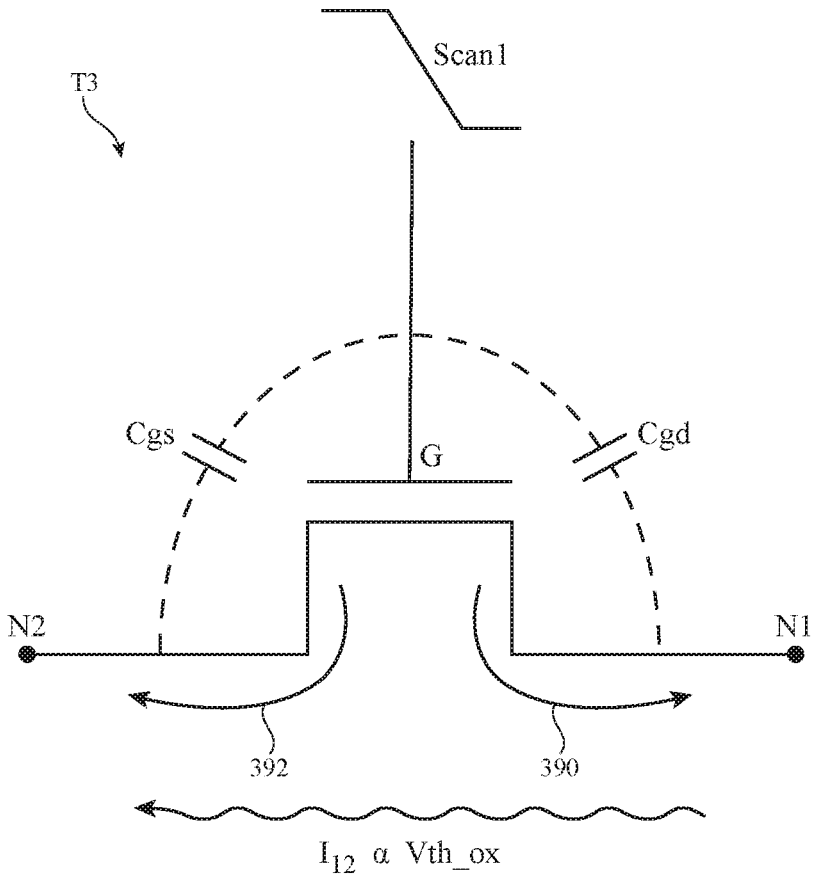
FIG. 3B is a diagram that illustrates the effect of charge injection and clock feedthrough when turning off a semiconducting-oxide transistor in the organic light-emitting diode display pixel shown in FIG. 3A.

FIG. 3B is a diagram that illustrates the effect of clock feedthrough and charge injection when turning off semiconducting-oxide transistor T3 in display pixel 22 of FIG. 3A. As shown in FIG. 3B, semiconducting-oxide transistor T3 has a parasitic gate-to-source capacitance Cgs coupled between its gate terminal and source terminal and a parasitic gate-to-drain capacitance Cgd coupled between its gate terminal and drain terminal. As signal Scan1 is driven low, the falling edge of the Scan1 pulse may be coupled to node N2 via parasitic capacitance Cgs. As a result of this transient parasitic coupling event, node N2 might experience an instantaneous voltage shift. This effect in which the falling signal edge behavior is coupled from the gate terminal of transistor T3 to the source terminal of transistor T3 is sometimes referred to as "clock feedthrough." The amount of Scan1 clock feedthrough is a function of parasitic capacitance Cgs, which is physical characteristic of transistor T3 that stays relatively fixed over time.

As signal Scan1 transitions from high to low, charge can also flow from the gate terminal of semiconducting-oxide transistor T3 to its source terminal (as indicated by charge injection path 392) and to its drain terminal (as indicated by charge injection path 390), a phenomenon that is sometimes referred to as "charge injection." The amount of charge 392 that is injected into node N2 and the amount of charge 390 that is injected into node N1 may generally depend on the relative difference in capacitance between nodes N1 and N2. If the difference between the total effective capacitance at node N1 and the total effective capacitance at node N2 is small, then charge injection amounts 390 and 392 will be relatively similar, so the ending voltages at nodes N1 and N2 will be equal. If, however, the difference between the total effective capacitance at node N1 and the total effective capacitance at node N2 is large, then charge injection amounts 390 and 392 will be different.

When signal Scan1 is asserted, the voltage at node N1 ($V_{N1}$) and the voltage at node N2 ($V_{N2}$) are equal. The combination of clock feedthrough and charge injection as transistor T3 is being switched off may, however, cause $V_{N1}$ to be mismatched from $V_{N2}$. If $V_{N1}$ is not equal to $V_{N2}$ when signal Scan1 is falling, a source-drain rebalancing current or recombination current such as current $I_{12}$ may flow from node N1 to node N2 or from node N2 to node N1, which will cause the voltage at node N2 to change even after transistor T3 is shut off.

Since both clock feedthrough and charge injection impact the voltage at node N2, which is shorted to the gate terminal of the drive transistor T2, both parasitic effects can potentially impact the luminance produced by OLED display pixel 22 since the amount of OLED emission current set at least partly by the gate voltage of transistor T2. The amount of voltage perturbation at node N2 and therefore the magnitude of rebalancing current $I_{12}$ may be a function of the threshold voltage of semiconducting-oxide transistor T3 (i.e., $I_{12}$ is dependent on semiconducting-oxide transistor threshold voltage Vth_ox). Although implementing transistor T3 as a semiconducting-oxide transistor helps minimize leakage current at the gate terminal of drive transistor T2, semiconducting-oxide transistor T3 may suffer from reliability issues.

Figure 5A:
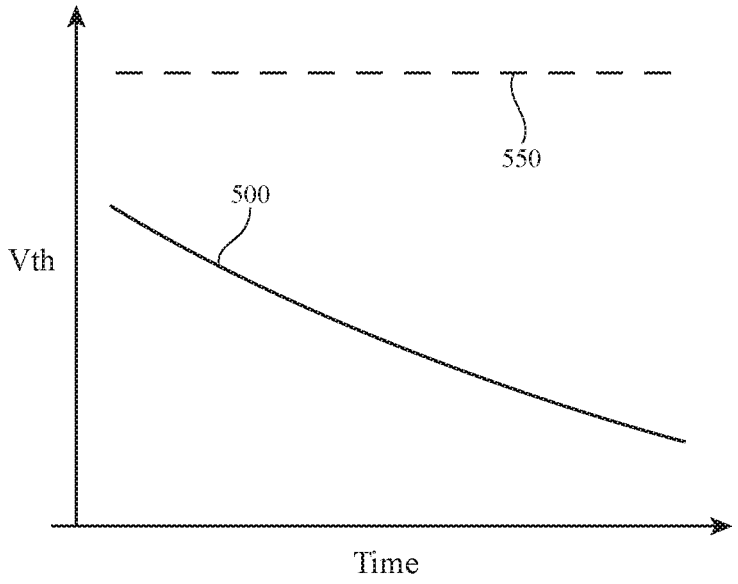
FIG. 5A is a diagram illustrating how the threshold voltage of a semiconducting-oxide transistor and how the threshold voltage of a silicon transistor vary over time.

During data programming operations of display pixel 22, scan clock signal Scan1 may be pulled up to a high voltage level VSH (e.g., 10V, more than 10 V, 1-10 V, more than 5 V, 1-5 V, 10-15 V, 20 V, more than 20 V, or other suitable positive/elevated voltage level) and also pulled down to a low voltage level VSL (e.g., −5 V, −1 V, 0 to −5 V, −5 to −10 V, less than 0 V, less than −1 V, less than −4 V, less than −5 V, less than −10 V, or other suitable negative/depressed voltage level). In particular, the application of negative voltage VSL at the gate terminal of semiconducting-oxide transistor T3 during the emission phase places a negative gate-to-source voltage stress across transistor T3, which can lead to oxide degradation (sometimes referred to as aging effects) and will cause Vth_ox to drift over time. FIG. 5A is a diagram illustrating how the threshold voltage of semiconducting-oxide transistor T3 varies over time. Trace 500 represents the threshold voltage of semiconducting-oxide transistor T3 over the lifetime of display 14. As illustrated by trace 500, Vth_ox will change over time (e.g., over 1-4 weeks of normal display operation, over 1-12 months of normal display operation, over at least one year of display operation, over 1-5 years of display operation, over 1-10 years of display operation, etc.).

Figure 5B:
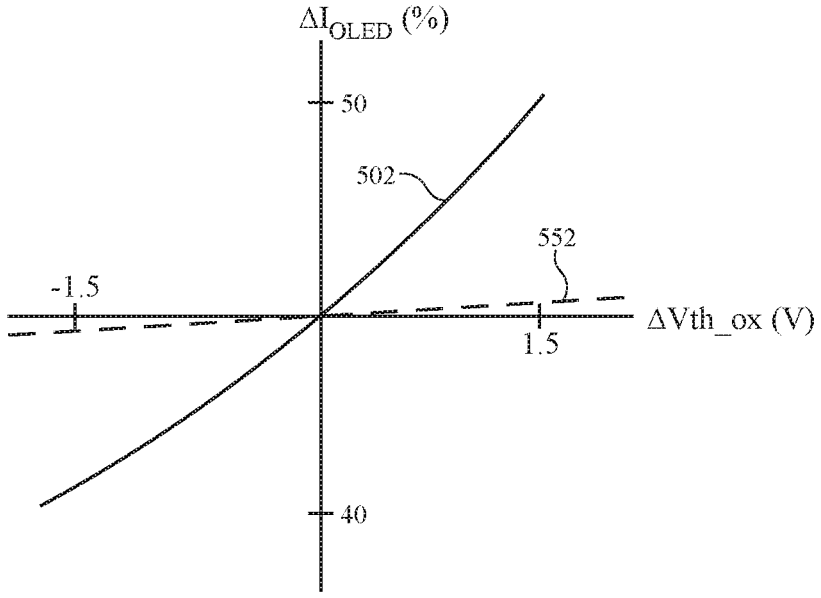
FIG. 5B is a diagram illustrating the sensitivity of OLED emission current to the threshold voltage of the semiconducting-oxide transistor in the organic light-emitting diode display pixel shown in FIG. 3A.

FIG. 5B plots the percentage change of the OLED emission current $I_{OLED}$ as a function of the amount of voltage change in Vth_ox. Trace 502 illustrates the sensitivity of $I_{OLED}$ to threshold voltage Vth_ox of transistor T3 in organic light-emitting diode display pixel 22 of FIG. 3A. As shown by trace 502 in FIG. 5B, current $I_{OLED}$ may increase by approximately 50% if Vth_ox deviates from the nominal threshold voltage amount by 1.5 V and may decrease by approximately 40% if Vth_ox deviates from the nominal threshold voltage amount by −1.5 V. This relatively high sensitivity of the OLED current to changes in Vth_ox as represented by trace 502 can cause non-ideal behaviors such as luminance non-uniformity across the display, luminance drop, and undesired color shifts in the display as Vth_ox drifts over time.

Figure 6A:
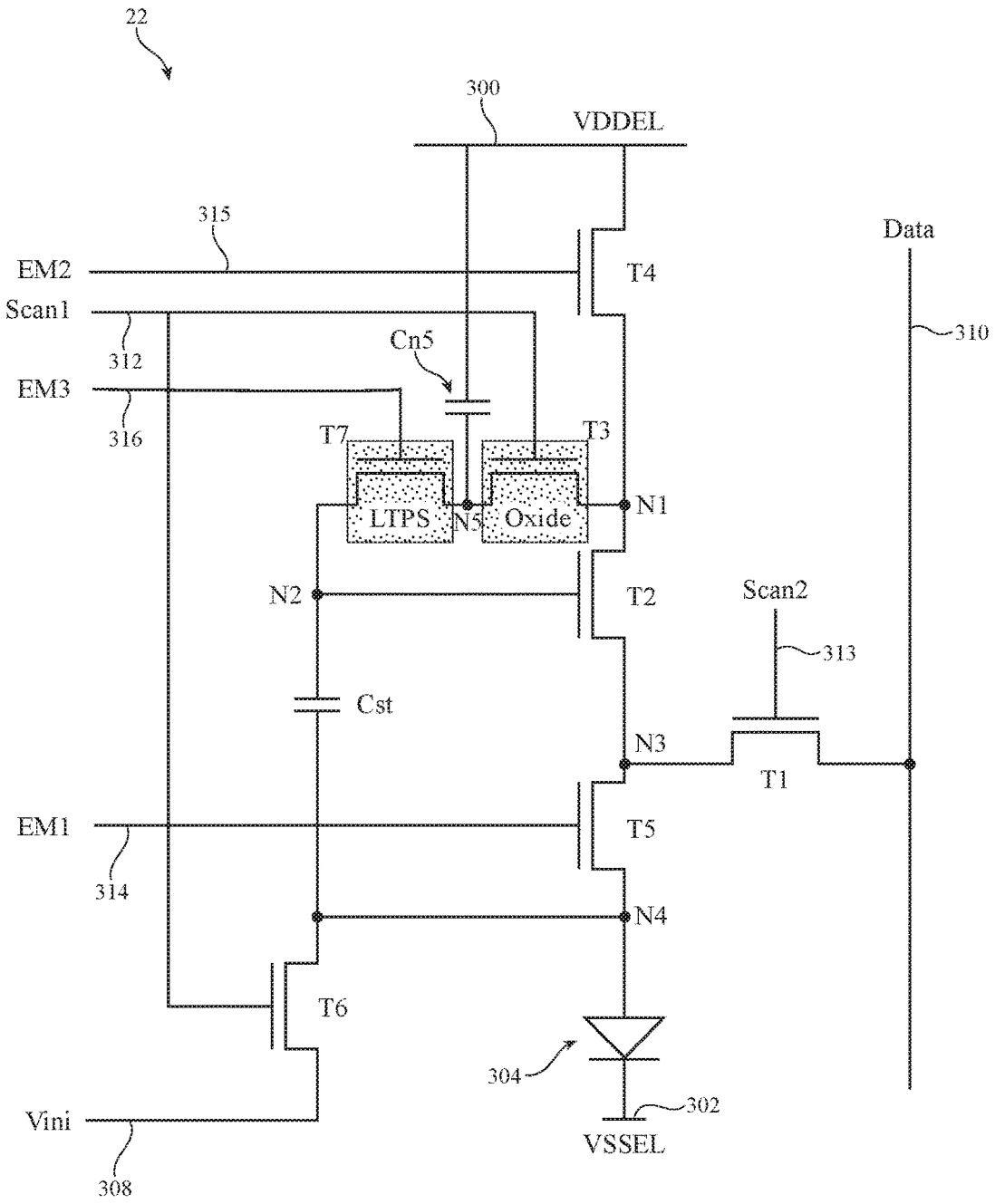
FIG. 6A is a circuit diagram of an illustrative organic light-emitting diode display pixel configured to produce an emission current having low sensitivity to oxide transistor threshold voltage in accordance with an embodiment.

To help mitigate the reliability issues associated with semiconducting-oxide transistor T3, a silicon transistor such as n-channel LTPS transistor T7 may be interposed between semiconducting-oxide transistor T3 and node N2 (see, e.g., OLED display pixel 22 in FIG. 6A). As shown in FIG. 6A, silicon transistor T7 has a drain terminal connected to the source terminal of transistor T3 at intermediate node N5, a source terminal connected to the gate terminal of drive transistor T2 at node N2, and a gate terminal that receives emission control signal EM3 via another emission line 316. Signal EM3 may be asserted (e.g., driven high) to selectively turn on transistor T7 and may be deasserted (e.g., driven low) to selectively turn off transistor T7. The remaining portion of pixel 22 in FIG. 6A marked with the same reference numerals as the pixel circuitry in FIG. 3A is interconnected using a similar arrangement and need not be reiterated in detail to avoid obscuring the present embodiment.

Figure 7:
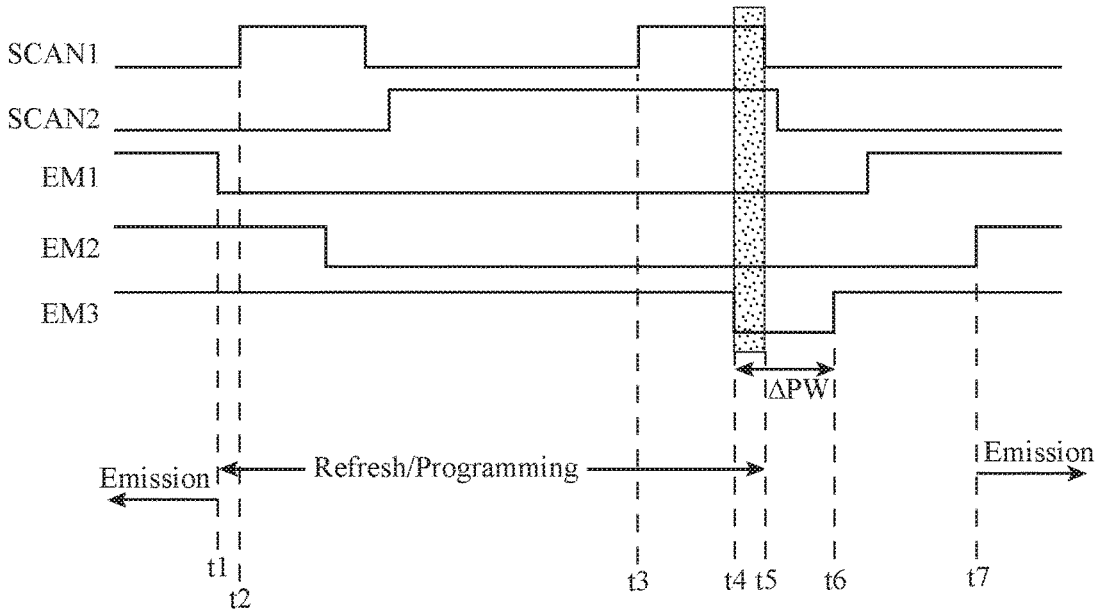
FIG. 7 is a timing diagram that illustrates the operation of the organic light-emitting diode display pixel shown in FIG. 6A in accordance with an embodiment.

FIG. 7 is a timing diagram that illustrates the operation of OLED display pixel 22 of the type shown in FIG. 6A. Prior to time t1, signals Scan1 and Scan2 are deasserted (e.g., the scan control signals are both driven low to VSL), whereas signals EM1, EM2, and EM3 are asserted (e.g., the emission control signals are both at positive power supply voltage levels). When both emission control signals EM1 and EM2 are high, an emission current will flow through drive transistor T2 into the corresponding organic light-emitting diode 304 to produce light during the emission phase. When emission control signal EM3 is asserted, node N5 is effectively shorted to node N2 via silicon transistor T7.

At time t1, emission control signal EM1 is deasserted (e.g., driven low) to temporarily suspend the emission phase, which begins the data programming phase. At time t2, signal Scan1 may be pulsed high to activate transistors T3 and T6, which initializes the voltage across capacitor Cst to a predetermined voltage difference (e.g., VDDEL minus Vini). At time t3, scan control signal Scan1 is pulsed high while signal Scan2 is asserted and while signals EM1 and EM2 are both deasserted to load a desired data signal from data line 310 into display pixel 22.

At time t5, scan control signal Scan1 is deasserted (e.g., driven low), which signifies the end of the data programming phase. As shown in FIG. 7, emission control signal EM3 may be temporarily pulsed low with a pulse width of ΔPW surrounding the falling clock edge of signal Scan1 (e.g., signal EM3 may be deasserted before the falling edge of Scan1 at time t4 and reasserted after Scan1 is low at time t6). Operated in this way, silicon transistor T7 is turned off first before semiconducting-oxide transistor T3 is turned off at time t5. Turning on transistor T7 during the emission phase can help reduce flicker since there won't be any current leaking through transistor T7 if it is switched on.

As semiconducting-oxide transistor T3 is turned off at time t5, clock feedthrough and charge injection induced from the falling edge of signal Scan1 can potentially cause the voltage at node N5 ($V_{N5}$) to be mismatched from the voltage at node N1 ($V_{N1}$), which would result in current $I_{15}$ to flow through transistor T3 to rebalance nodes N1 and N5. When transistor T7 is later turned on at time t6, $V_{N5}$ (which is a function of the threshold voltage Vth_ox of transistor T3) will be rebalanced with $V_{N2}$, which means that the gate voltage of drive transistor T2 is subject to the risk of being sensitive to any drift in Vth_ox.

To help minimize rebalancing current $I_{15}$ and therefore mitigate this sensitivity of the OLED current to Vth_ox, a matching capacitor such as capacitor Cn5 may be attached to node N5 (see, e.g., FIG. 6A). Capacitor Cn5 has a capacitance value that equalizes the total effective capacitance at node N5 with the total effective capacitance at node N1. In other words, capacitor Cn5 should have a value that allows $V_{N1}$ to be relatively equal to $V_{N5}$ immediately after the Scan1 falling edge at time t4, thereby minimizing any potential rebalancing current $I_{15}$ to flow through semiconducting-oxide transistor T3. Reducing the amount of rebalancing current $I_{15}$ through transistor T3, which is a function of Vth_ox of semiconducting-oxide transistor T3, therefore mitigates the sensitivity of the drive transistor gate voltage at node N2 (which directly controls the OLED emission current) to Vth_ox. Capacitor Cn5 may be substantially smaller than storage capacitor Cst (e.g., Cn5 may be at least two times smaller than Cst, at least four times smaller, at least eight times smaller, at least 10 times smaller, 2-10 times smaller, 10-20 times smaller, 20-100 times smaller, 100-1000 times smaller, or more than 1000 times smaller than Cst).

The addition of silicon transistor T7 therefore enables capacitance matching between nodes N1 and N5. Matching the capacitance at the source and drain terminals of semiconducting-oxide transistor T3 in pixel 22 of FIG. 3A is not feasible since the capacitance of Cst is relatively large. Thus, any attempt to match the capacitance at node N1 to Cst would require adding a large capacitor, which would dramatically increase pixel area. Compared to semiconducting-oxide transistor T3, silicon transistor T7 exhibits improved physical characteristics at least in terms of clock feedthrough and charge injection.

In general, silicon transistor T7 exhibits substantially lower parasitic gate-to-source capacitance Cgs compared to semiconducting-oxide transistor T3, which reduces the effect of clock feedthrough as emission control signal is asserted at time t6. In one suitable arrangement, silicon transistor T7 may be implemented as a top-gate silicon transistor (e.g., a thin-film transistor with a metal gate conductor formed over LTPS semiconductor material) to optimize for minimal Cgs. In contrast to a top-gate silicon transistor, a bottom-gate silicon transistor (e.g., a thin-film transistor with a metal gate conductor formed underneath LTPS semiconductor material) tends to exhibit relatively larger Cgs.

In contrast to semiconducting-oxide transistor T3 having a threshold voltage Vth_ox that drifts over the lifespan of the display, silicon transistor T7 has a threshold voltage Vth_1tps that stays relatively constant over time (see, e.g., trace 550 in FIG. 5A). This is because silicon transistors are generally more reliable than semiconducting-oxide transistors, at least in terms of channel integrity. Thus, even as transistor T7 is turned on at time t6, the amount of charge injection to node N2 and the amount of rebalancing current $I_{52}$ that flows through transistor T7 to node N2 will be constant and predictable over time.

Configured in this way, the corresponding OLED current produced by display pixel 22 of FIG. 6A at time t7 when emission control signals EM1 and EM2 are both high is substantially less sensitive to changes in Vth_ox as shown by trace 552 in FIG. 5B. As illustrated by trace 552, even if Vth_ox deviates by +/−1.5 V, the resulting change in $I_{OLED}$ would be at least less than 20%, less than 10%, less than 5%, less than 1%, 10 times less than the sensitivity of trace 502, 20 times less than the sensitivity of trace 502, etc. Mitigating OLED current sensitivity to deviations in Vth_ox of transistor T3 provides luminance uniformity across the display, reduces luminance drop over the lifetime of the display, reduces color shift over the lifespan of the display, and diminishes other non-ideal behaviors of the display.

In the example of FIG. 6A, capacitor Cn5 (e.g., a discrete capacitor structure configured to roughly equalize the total capacitance at node N5 with the total capacitance at node N1 for the purpose of preventing a rebalancing current from flowing through semiconducting-oxide transistor T3 after signal Scan1 is deasserted) is coupled between node N5 and positive power supply line 300. This particular configuration is merely illustrative. FIGS. 6B-6G are diagrams showing different capacitor arrangements for reducing the rebalancing current after transistor T3 in FIG. 6A is turned off.

Figure 6B:
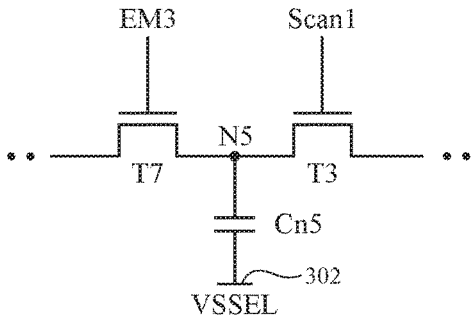
FIGS. 6B-6G are diagrams showing different capacitor configurations for reducing a re-balancing current after the oxide-semiconducting transistor in the display pixel of FIG. 6A is turned off in accordance with some embodiments.
Figure 6C:
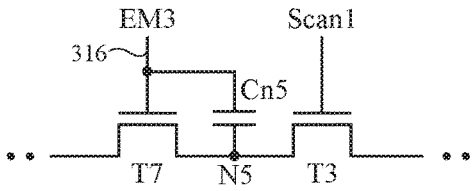
Figure 6D:
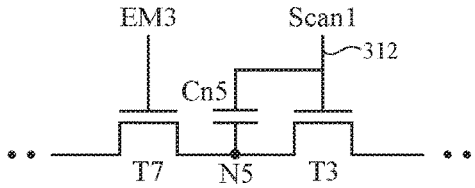

FIG. 6B shows another suitable arrangement where capacitor Cn5 has a first terminal connected to node N5 and a second terminal connected to ground line 302 (i.e., the ground line on which ground power supply voltage VSSEL is provided). FIG. 6C shows another suitable arrangement in which capacitor Cn5 has a first terminal connected node N5 and a second terminal connected to emission line 316 (i.e., the terminal at which emission control signal EM3 is provided). FIG. 6D shows yet another suitable arrangement in which capacitor Cn5 has a first terminal connected node N5 and a second terminal connected to scan line 312 (i.e., the terminal at which scan control signal Scan1 is provided).

Figure 6E:
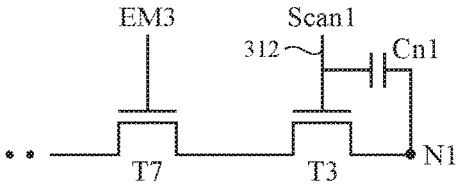
Figure 6F:
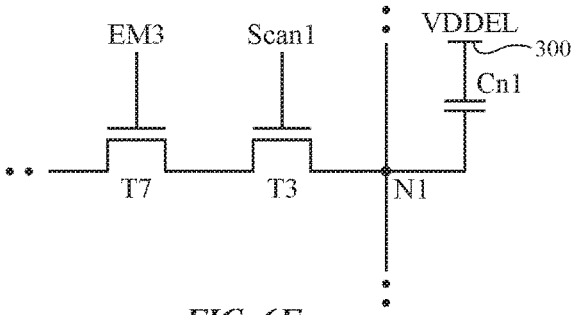
Figure 6G:
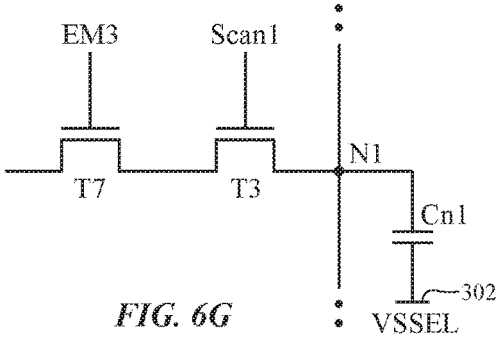

The examples shown in FIGS. 6A-6D in which the additional capacitance matching/balancing capacitor Cn5 is coupled to node N5 is merely illustrative. The additional capacitor need not always be coupled to node N5. In other suitable embodiments, the additional capacitance balancing capacitor for preventing a rebalancing current from flowing through semiconducting-oxide transistor T3 after signal Scan1 is deasserted might instead be attached to node N1 (see, e.g., capacitor Cn1 in FIGS. 6E-6G). FIG. 6E shows one suitable arrangement in which capacitor Cn1 has a first terminal connected node N1 and a second terminal connected to scan line 312 (i.e., the terminal at which scan control signal Scan1 is provided). FIG. 6F shows another suitable arrangement in which capacitor Cn1 has a first terminal connected node N1 and a second terminal connected to positive power supply line 300 (i.e., the terminal at which positive power supply voltage VDDEL is provided). FIG. 6G shows yet another suitable arrangement in which capacitor Cn1 has a first terminal connected node N1 and a second terminal connected to ground line 302.

The examples of FIGS. 6A-6G in which additional capacitance is coupled to nodes N5 and N1 are merely illustrative. If desired, additional capacitance may be coupled to both node N5 and node N1 (i.e., a first additional capacitor may be attached to node N5 while a second additional capacitor may be attached to node N1 in a single embodiment). In general, other suitable ways for ensuring that $V_{N5}$ is substantially equal to $V_{N1}$ when transistor T3 is turned off and for minimizing the rebalancing current flowing through transistor T3 after signal Scan1 is deasserted may be implemented.

In general, drive transistor T2 and semiconducting-oxide transistor T3 should be implemented as n-channel thin-film transistors. If desired, the remaining transistors T1 and T4-T7 can optionally be implemented as p-channel thin-film transistors. In contrast to n-channel transistors, p-channel transistors are active-low switches (i.e., a p-channel transistor needs to receive a low voltage signal at its gate to turn it on). Thus, if transistor T4 were implemented as a p-channel transistor (as an example), the waveform of signal EM2 would be an inverted version of what is shown in FIG. 7.

In another suitable arrangement, transistors T3 and T6 may be implemented as semiconducting-oxide transistors while remaining transistors T1, T2, T4, T5, and T7 are silicon transistors. Since both transistors T3 and T6 are both controlled by signal Scan1, forming them as the same transistor type can help simplify fabrication.

In yet another suitable arrangement, transistors T3, T6, and also T2 may be implemented as semiconducting-oxide transistors while remaining transistors T1, T4, T5, and T7 are silicon transistors. Drive transistor T2 has a threshold voltage that is critical to the emission current of pixel 22. Forming drive transistor T2 as a top-gate semiconducting-oxide transistor can help reduce hysteresis (e.g., a top-gate IGZO transistor experiences less threshold voltage hysteresis than a silicon transistor). If desired, transistors T1-T6 may all be semiconducting-oxide transistors.

The example of FIG. 6A in which silicon transistor T7 receives a separate emission control signal EM3 is merely illustrative. To eliminate this additional emission line, silicon transistor T7 can be controlled by scan control signal Scan1 (see, e.g., OLED display pixel 22 in FIG. 8). The remaining portion of pixel 22 in FIG. 8 is interconnected using a similar arrangement and need not be reiterated in detail to avoid obscuring the present embodiment.

Figure 8:
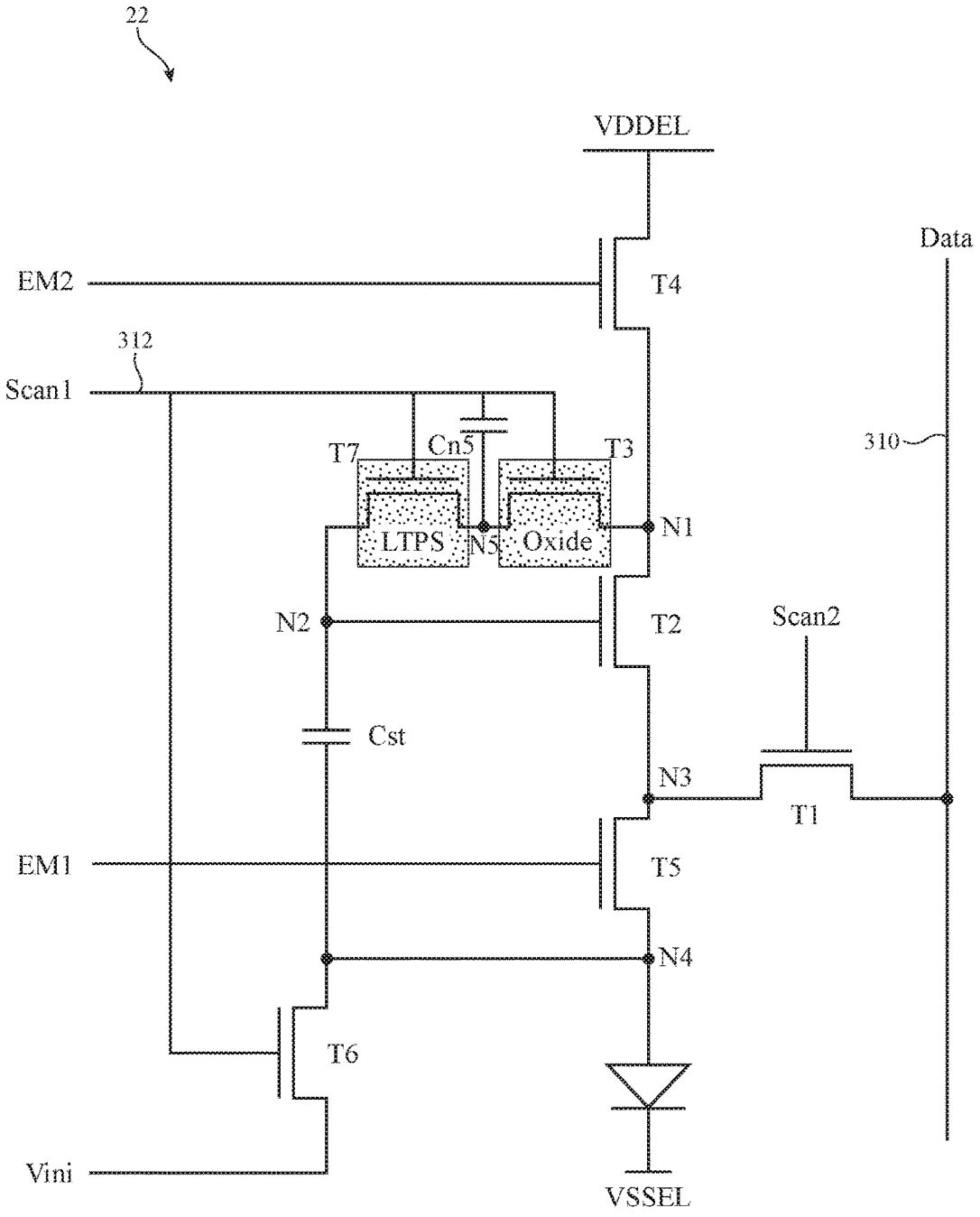
FIG. 8 is a circuit diagram of an illustrative organic light-emitting diode display pixel configured to produce an emission current having low sensitivity to oxide transistor threshold voltage, where the semiconducting-oxide transistor and a series-connected silicon transistor are controlled by the same scan signal in accordance with an embodiment.
Figure 9:
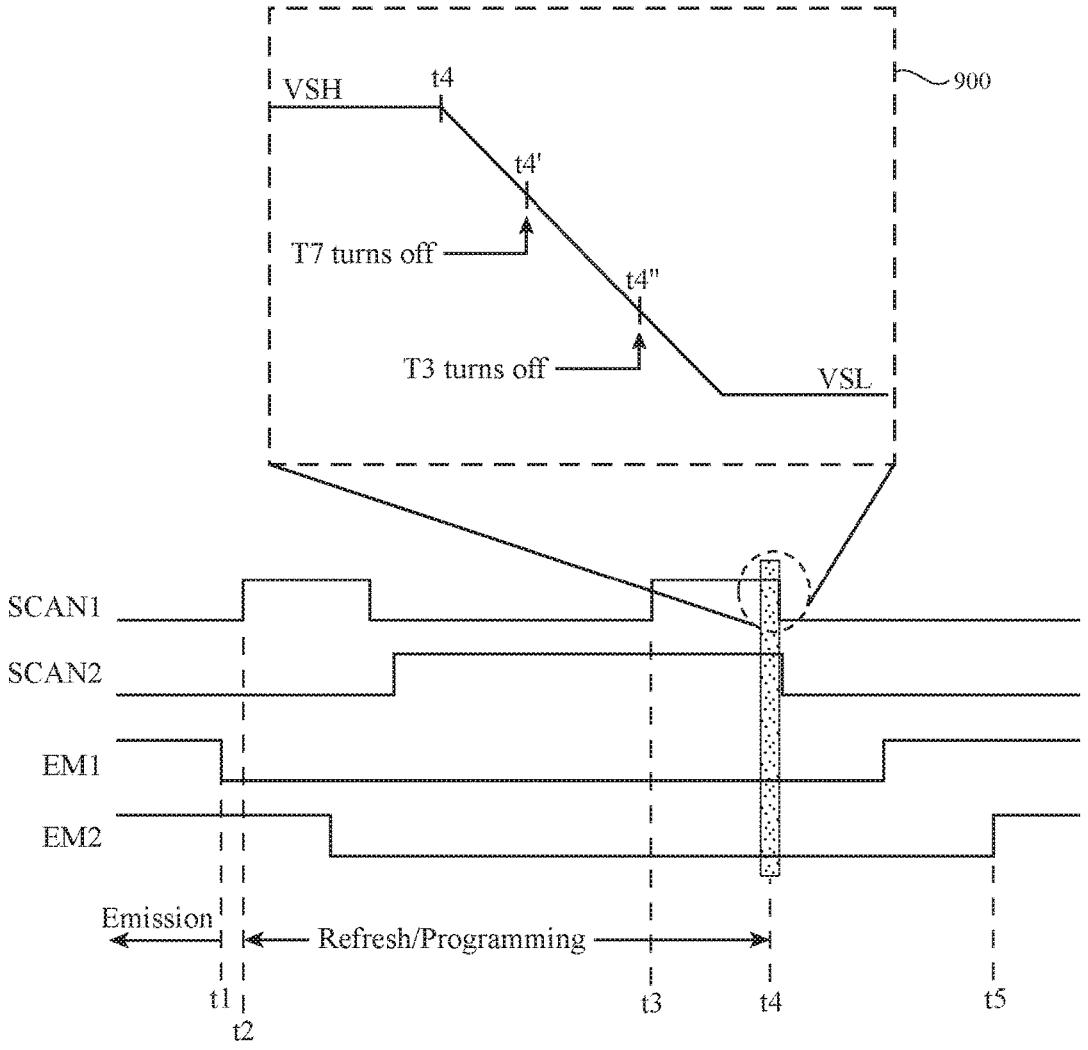
FIG. 9 is a timing diagram that illustrates the operation of the organic light-emitting diode display pixel shown in FIG. 8 in accordance with an embodiment.

FIG. 9 is a timing diagram that illustrates the operation of OLED display pixel 22 of the type shown in FIG. 8. Prior to time t1, signals Scan1 and Scan2 are deasserted (e.g., the scan control signals are both at VSL), whereas signals EM1 and EM2 are asserted (e.g., the emission control signals are both at positive power supply voltage levels). When both emission control signals EM1 and EM2 are high, an emission current will flow through drive transistor T2 into the corresponding organic light-emitting diode 304 to produce light during the emission phase.

At time t1, emission control signal EM1 is deasserted (e.g., driven low) to temporarily suspend the emission phase, which initiates the data programming phase. At time t2, signal Scan1 may be pulsed high to activate transistors T3, T6, and T7, which initializes the voltage across capacitor Cst to a predetermined voltage difference (e.g., VDDEL minus Vini). At time t3, scan control signal Scan1 is pulsed high while signal Scan2 is asserted and while signals EM1 and EM2 are both deasserted to load a desired data signal from data line 310 into display pixel 22.

At time t4, scan control signal Scan1 is deasserted (e.g., driven low), which signifies the end of the data programming phase. Since scan control signal Scan1 controls both transistors T3 and T7 in the embodiment of FIG. 8, transistors T3 and T7 may both be turned off at the falling edge of Scan1. However, it is generally desirable for transistor T7 to be turned off first before transistor T3 is turned off to help isolate node N2 from the parasitic effects of semiconducting-oxide transistor T3. In order to ensure that transistor T7 is turned off before transistor T3 is turned off at the falling edge of signal Scan1, transistors T3 and T7 may be provided with different threshold voltage levels. Assuming transistors T3 and T7 are both implemented as n-channel transistors, the threshold voltage of transistor T7 is preferably greater than the threshold voltage of transistor T3 so that transistor T7 will be turned off first. This might also be true for the embodiments of FIGS. 6A-6G. This sequence of events is shown in a magnified view 900 in FIG. 9. For instance, as signal Scan1 transistors from VSH to VSL at time t4, silicon transistor T7 will be turned off first at time t4', whereas semiconducting-oxide transistor T3 will be subsequently turned off at time t4".

Before transistor T7 is turned off from time t4 to t4', there will still be current $I_{15}$ flowing through transistor T3, which will impact the voltage at node N2 since transistor T7 is still on. If current $I_{15}$ flows through transistor T3 to rebalance nodes N1 and N5 while transistor T7 is on, the gate voltage of drive transistor T2 will be subject to the risk of being sensitive to any drift in Vth_ox. To help minimize current $I_{15}$ and therefore mitigate this sensitivity of the OLED current to Vth_ox, a matching capacitor such as capacitor Cn5 may be attached to node N5 (see, e.g., FIG. 8). Capacitor Cn5 has a capacitance value that equalizes the total effective capacitance at node N5 with the total effective capacitance at node N1. In other words, capacitor Cn5 should have a value that allows $V_{N1}$ to be relatively equal to $V_{N5}$ immediately after the Scan1 falling edge at time t4, thereby minimizing any potential rebalancing current $I_{15}$ to flow through semiconducting-oxide transistor T3. Reducing the amount of rebalancing current $I_{15}$ through transistor T3, which is a function of Vth_ox of semiconducting-oxide transistor T3, therefore mitigates the sensitivity of the drive transistor gate voltage at node N2 (which directly controls the OLED emission current) to Vth_ox. Moreover, the value of capacitor Cn5 may be further tuned to reduce flicker.

The addition of silicon transistor T7 therefore enables capacitance matching between nodes N1 and N5. Matching the capacitance at the source and drain terminals of semiconducting-oxide transistor T3 in pixel 22 of FIG. 3A is not feasible since the capacitance of Cst is relatively large. Thus, any attempt to match the capacitance at node N1 to Cst would require adding a large capacitor, which would dramatically increase pixel area. Compared to semiconducting-oxide transistor T3, silicon transistor T7 exhibits improved physical characteristics at least in terms of clock feedthrough and charge injection.

In general, silicon transistor T7 exhibits substantially lower parasitic gate-to-source capacitance Cgs compared to semiconducting-oxide transistor T3, which reduces the effect of clock feedthrough as emission control signal is asserted at time t6. In one suitable arrangement, silicon transistor T7 may be implemented as a top-gate silicon transistor (e.g., a thin-film transistor with a metal gate conductor formed over LTPS semiconductor material) to optimize for minimal Cgs. In contrast to semiconducting-oxide transistor T3 having a threshold voltage Vth_ox that drifts over the lifespan of the display, silicon transistor T7 has a threshold voltage Vth_1tps that stays relatively constant over time (see, e.g., trace 550 in FIG. 5A). This is because silicon transistors are generally more reliable than semiconducting-oxide transistors, at least in terms of channel integrity. Thus, even as transistor T7 is turned off at time t4', the amount of charge injection to node N2 and the amount of rebalancing current $I_{52}$ that flows through transistor T7 to node N2 will be constant and predictable over time.

Configured in this way, the corresponding OLED current produced by display pixel 22 of FIG. 8 at time t5 when emission control signals EM1 and EM2 are both high is substantially less sensitive to changes in Vth_ox as shown by trace 552 in FIG. 5B. Mitigating OLED current sensitivity to deviations in Vth_ox of transistor T3 provides luminance uniformity across the display, reduces luminance drop over the lifetime of the display, reduces color shift over the lifespan of the display, and diminishes other non-ideal behaviors of the display.

In the example of FIG. 8, capacitor Cn5 (e.g., a discrete capacitor circuit configured to equalize the total capacitance at node N5 with the total capacitance at node N1 for the purpose of preventing a rebalancing current from flowing through semiconducting-oxide transistor T3 as signal Scan1 is deasserted) is coupled between node N5 and scan line 312. This particular configuration is merely illustrative. If desired, one or more additional capacitor components can be coupled to node N5 and/or node N1 in any suitable manner (see, e.g., FIGS. 6A-6G).

The various embodiments described in connection with FIGS. 6-9 in which a silicon transistor such as transistor T7 and a capacitor such as capacitor Cn5 or Cn1 are used to reduce the sensitivity of OLED emission current to potential changes in Vth_ox of semiconducting-oxide transistor T3 is merely illustrative. In general, these techniques may be applied to any type of display pixel that includes one or more drive transistors and at least three accompanying switching transistors, at least four accompanying switching transistors, at least five accompanying switching transistors, at least six accompanying switching transistors, 1-10 associated switching transistors, 10 or more associated switching transistors, etc. to help reduce flicker, provide luminance uniformity, and prevent luminance drop and color shifts over the lifetime of low-refresh-rate displays.

Figure 10:
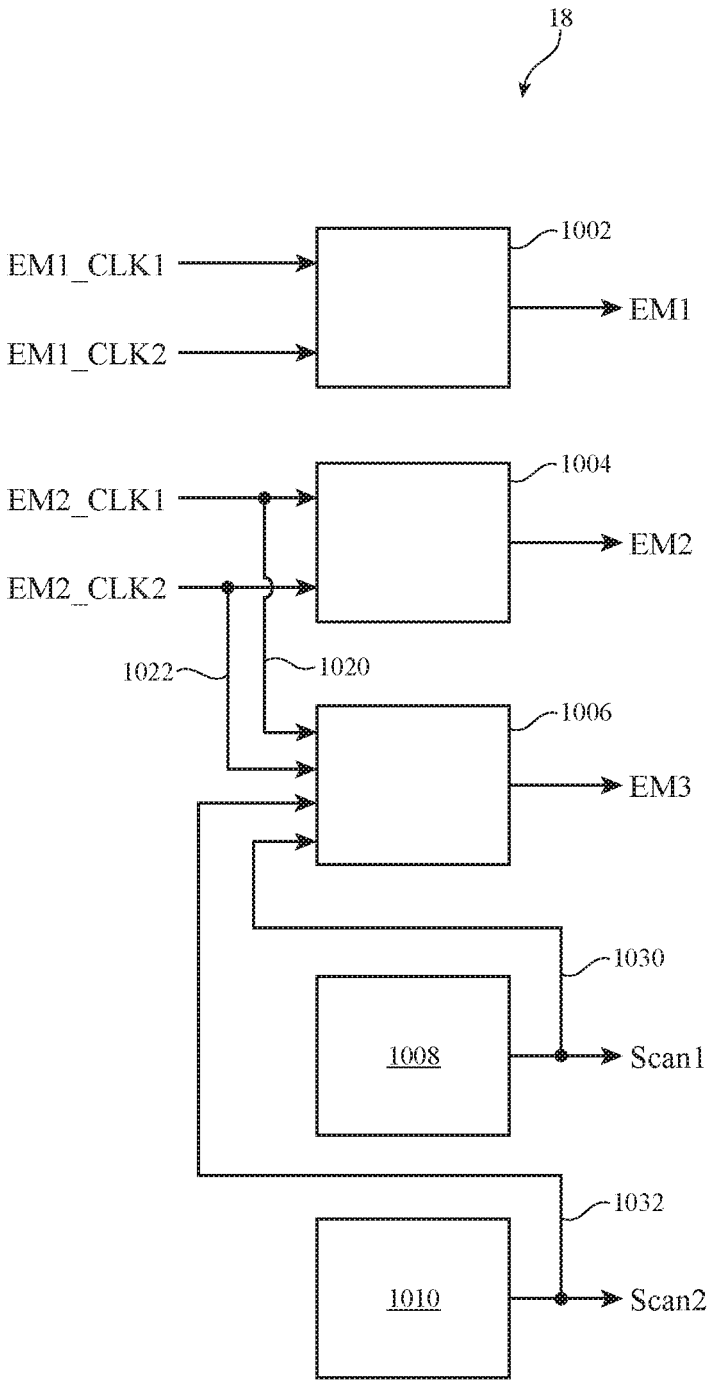
FIG. 10 is a diagram of illustrative gate driver circuits configured to generate corresponding emission and scan control signals in accordance with an embodiment.

The various scan control signals and emission control signals for controlling pixel 22 of the type shown in FIG. 6A may be generated using respective scan line driver circuits and emission line driver circuits formed as part of row driver circuitry 18 (FIG. 1). FIG. 10 is a diagram of illustrative gate driver circuits configured to generate corresponding emission and scan control signals. As shown in FIG. 10, row driver circuitry 18 may include a first emission line driver 1002 configured to generate emission control signal EM1, a second emission line driver 1004 configured to generate emission control signal EM2, a third emission line driver 1006 configured to generate emission control signal EM3, a first scan line driver 1008 configured to generate scan control signal Scan1, and a second scan line driver 1010 configured to generate scan control signal Scan2.

The emission line drivers may each be controlled using a respective pair of emission clock signals. For example, first emission line driver 1002 may be controlled using a first clock pair EM1_CLK1 and EM1_CLK2, whereas second emission line driver 1004 may be controlled using a second clock pair EM2_CLK1 and EM2_CLK2. In particular, emission line driver 1006 may be controlled using one of the emission clock pairs. In the example of FIG. 10, emission line driver 1006 is controlled using the second clock pair EM2_CLK1 and EM2_CLK2, as shown by routing paths 1020 and 1022, respectively. Emission line driver 1006 may also be controlled using scan control signals Scan1 and Scan2, as indicated by feedback routing paths 1030 and 1032, respectively. Using and sharing control signals from other gate drivers to control emission line driver 1006 in this way can dramatically reduce circuit area. Moreover, while drivers 1002, 1004, 1008, and 1010 may each require a start pulse signal, driver 1006 does not require a separate start pulse signal, which also helps simplify design complexity.

Figure 11A:
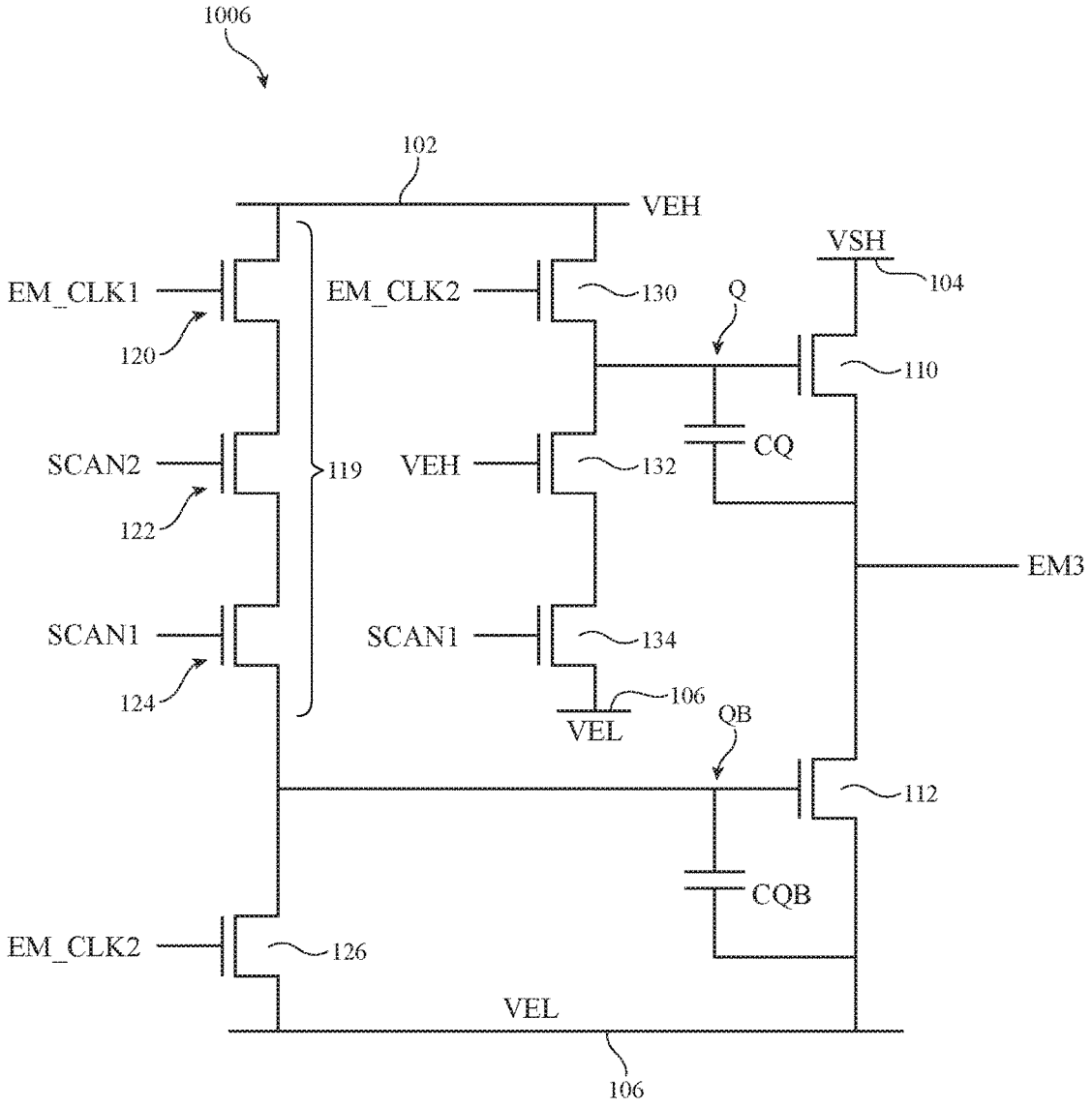
FIG. 11A is a circuit diagram of an emission gate driver that receives control signals associated with other gate driver circuits in accordance with an embodiment.

FIG. 11A is a circuit diagram shown one suitable implementation of emission line driver 1006. As shown in FIG. 11A, emission line driver 1006 may include a pull-up output transistor 110 and a pull-down output transistor 112 coupled in series between first power supply line 104 (e.g., a power supply line on which voltage VSH is provided) and second power supply line 106 (e.g., a power supply line on which voltage VEL is provided). Voltage VSH may be a positive power supply line borrowed from one of the scan line drivers 1008 and/or 1010, whereas voltage VEL may be a negative power supply line borrowed from one of the other emission line drivers 1002 and/or 1004. In general, voltage VSH may be greater than VDDEL, whereas voltage VEL may be less than VSSEL. As an example, if VDDEL is 8.5 V, VSH might be 10.5 V. As another example, if VSSEL is 0 V, VEL might be −3 V. These examples are merely illustrative and do not serve to limit the scope of the present embodiments. If desired, VSH need not be a fixed power supply voltage and may be independently adjusted for increased flexibility. The gate terminal of transistor 110 may be labeled as node Q, whereas the gate terminal of transistor 112 of transistor 112 may be labeled as node QB. A first capacitor CQ is coupled across the gate and source terminals of transistor 110, whereas a second capacitor CQB is coupled across the gate and source terminals of transistor 112.

Node QB may be driven low or deasserted using transistor 126. Transistor 126 has a gate terminal that receives EM_CLK2 (e.g., either EM1_CLK2 or EM2_CLK2 of FIG. 10). On the other hand, node QB may be driven high or asserted using transistors 120, 122, and 124 coupled in series between third power supply line 102 (e.g., a power supply line on which voltage VEH is provided) and node QB. Voltage VEH may be a positive power supply line borrowed from one of the emission line drivers 1002 and/or 1004. In general, voltage VEH may be greater than VDDEL and also greater than VSH. As an example, if VSH is 10.5 V, VEH might be 12.5 V. Transistor 120 has a gate terminal that receives EM_CLK1 (e.g., either EM1_CLK1 or EM2_CLK1 of FIG. 10). Transistor 122 has a gate terminal that receives Scan2. Transistor 124 has a gate terminal that receives Scan1. Connected in series in this way, transistors 120, 122, and 124 may form a logic AND circuit 119 that drives node QB high only when all of signals EM_CLK1, Scan1, and Scan2 are high at the same time.

Node Q may be driven high or asserted using transistor 130 coupled between node Q and power supply line 102. Transistor 130 has a gate terminal that receives EM_CLK2. On the other hand, node Q may be driven low or deasserted using transistors 132 and 134 coupled in series between node Q and power supply line 106. Transistor 132 has a gate terminal that receives fixed power supply voltage VEH from power supply line 102 (i.e., transistor 132 is always on). Transistor 134 has a gate terminal that receives scan control line Scan1. Configured in this way, all control signals received at driver 1006 are borrowed from other gate driver circuits, which dramatically reduces display border area requirements.

Figure 11B:
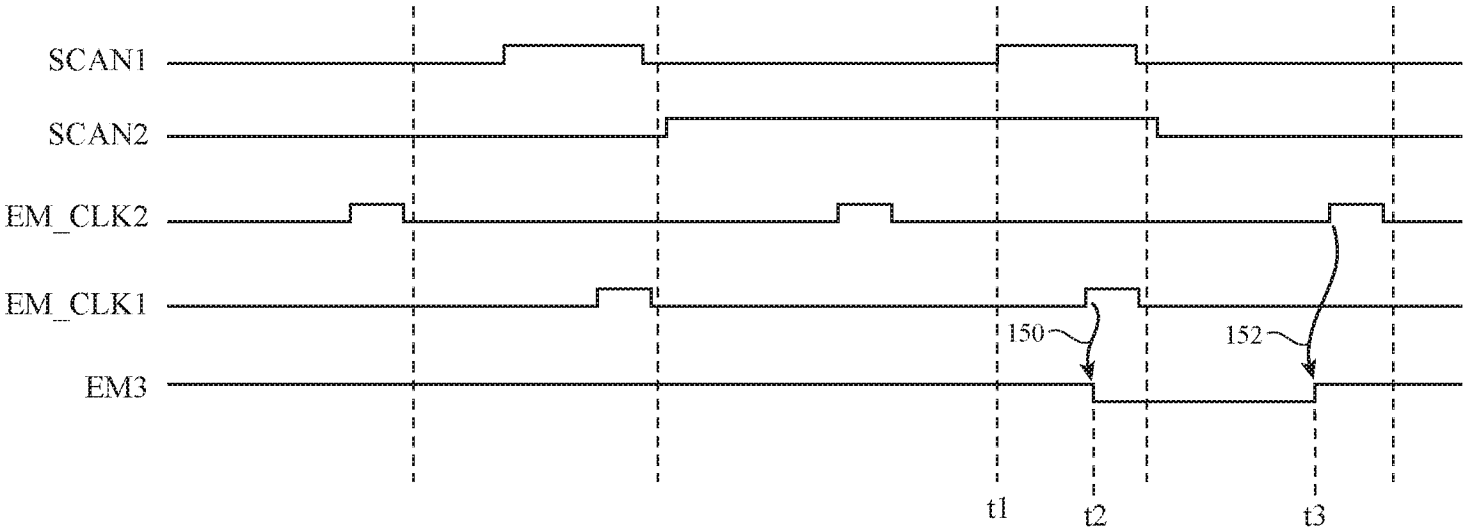
FIG. 11B is a timing diagram illustrating the operation of the emission gate driver shown in FIG. 11A in accordance with an embodiment.

FIG. 11B is a timing diagram illustrating the operation of emission line driver 1006 of the type described in connection with FIG. 11A. As shown in FIG. 11A, signals Scan1 and Scan2 has different pulse widths, and signal EM_CLK1 is a delayed version of signal EM_CLK2. At time t1, signal Scan1 may be first pulsed high while signal Scan2 is already high. Asserting signal Scan1 turns on transistor 134, which drives node Q towards voltage VEL and turns off transistor 110. This helps eliminate any potential driving contention when transistor 112 is subsequently turned on.

At time t2, signal EM_CLK1 is pulsed high, which turns on transistor 120. Since all of signals EM_CLK1, Scan1, and Scan 2 are high at this time, AND logic 119 is activated to pull node QB high, which turns on pull-down transistor 112 to drive signal EM3 low (as indicated by arrow 150).

Signal EM3 will remain deasserted until time t3, when signal EM_CLK2 is pulsed high. When signal EM_CLK2 is pulsed high, transistor 126 is turned on to pull node QB towards VEL, which turns off transistor 112. This helps eliminate any potential driving contention with transistor 110. Asserting EM_CLK2 also turns on transistor 130 to pull node Q towards VEH, which turns on transistor 110 to drive signal EM3 back up high (as indicated by arrow 152) for the remainder of the emission period.

The implementation of emission gate driver 1006 as shown in FIG. 11A may be especially suited for low frequency display operation since it is easier to maintain signal EM3 at a high voltage level when a large capacitor CQ is present at the gate terminal of pull-up output transistor 110. In general, however, emission gate driver 1006 of FIG. 11A may be used to support display operation of any suitable frequency.

Figure 12:
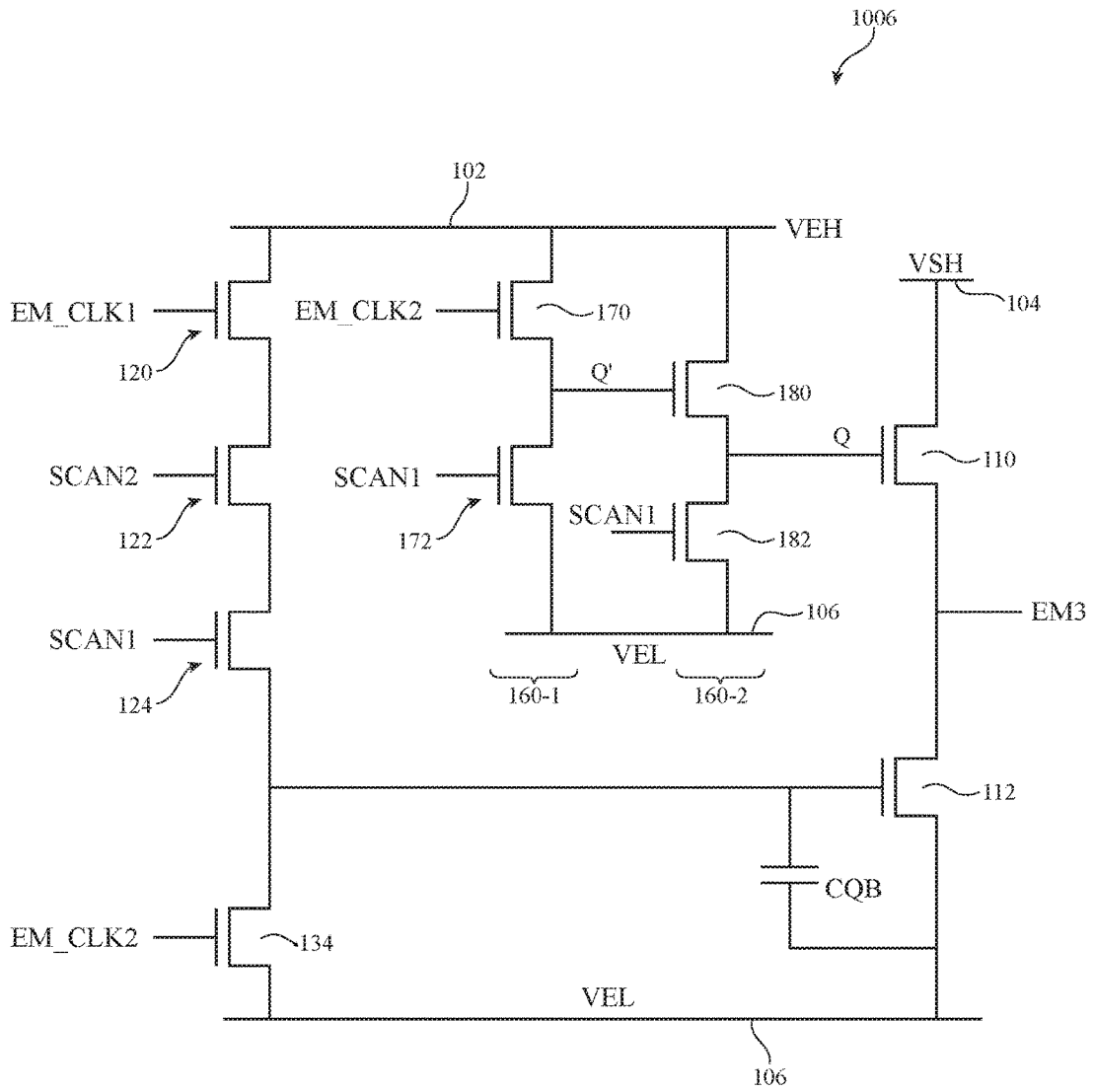
FIG. 12 is a circuit diagram of an emission gate driver having fewer capacitors than the emission gate driver shown in FIG. 11A in accordance with an embodiment.

FIG. 12 is a circuit diagram showing another suitable implementation of emission line driver 1006. Structural components with the same reference numerals and connections as those already described in connection with FIG. 11A need not be reiterated, as they serve substantially similar functions. Note, however, that node Q is controlled using a two-stage sub-driver circuit. As shown in FIG. 12, driver 1006 may include a first sub-driver stage 160-1 connected in series with a second sub-driver stage 160-2. First stage 160-1 includes transistor 170 connected in series with transistor 172 between power supply lines 102 and 106. Transistor 170 has a gate terminal that receives EM_CLK2, whereas transistor 172 has a gate terminal that receives Scan1. The output of stage 160-1 is labeled node Q'. Second stage 160-2 includes transistor 180 connected in series with transistor 182 between power supply lines 102 and 106. Transistor 180 has a gate terminal that is directly connected to node Q', whereas transistor 182 has a gate terminal that also receives Scan1. The output of stage 160-2 is directly connected to node Q.

The signals controlling emission line driver 1006 are identical to those already shown and described with respect to FIG. 11B, the details of which need not be reiterated for brevity. In contrast to the design of FIG. 11B where transistor 130 receiving EM_CLK2 is directly coupled to node Q, the dual-stage implementation of FIG. 12 can help isolate the clock coupling from the gate terminal of transistor 170 from node Q. As a result, the total capacitance required at node Q can be made much smaller. In particular, note that the design of FIG. 12 does not even require a discrete capacitor CQ across the gate and source terminals of transistor 110, which substantially reduces circuit area.

The embodiments of FIGS. 6-12 that involve using a silicon transistor such as transistor T7 to isolate the threshold voltage variation associated with oxide transistor T3 is merely illustrative. In accordance with another suitable arrangement, the pulse width of the emission signals can be incrementally adjusted over time to help compensate for the expected threshold voltage shift associated with oxide transistor T3. During emission operations, the emission control signals (see, e.g., emission control signals EM1 and EM2 in the example of FIG. 3) may be toggled using a pulse width modulation (PWM) scheme to control the luminance of the display. Augmenting the pulse width of the emission control signals would increase the PWM duty cycle, which boosts the corresponding luminance of the display. In contrast, reducing the pulse width of the emission control signals would decrease the PWM duty cycle, which diminishes the corresponding luminance of the display.

Figure 13A:
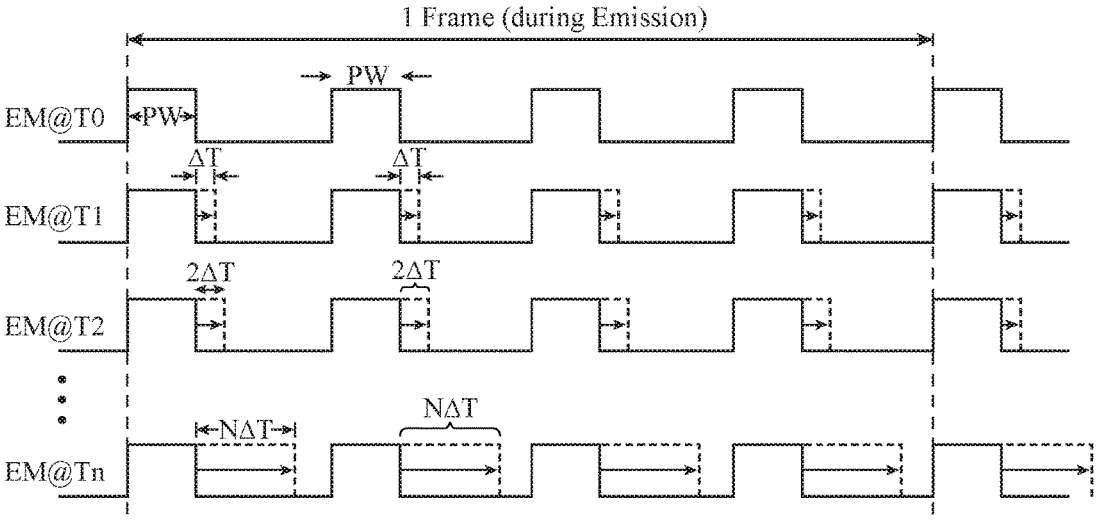
FIG. 13A is a timing diagram showing how the pulse width of emission signals can be increased over the lifetime of a display to compensate for luminance drops in accordance with an embodiment.

FIG. 13A is a timing diagram showing how the pulse width of emission signals can be increased over the lifetime of display 14 to compensate for luminance drops in accordance with an embodiment. As shown in FIG. 13A, emission control signals EM (representative of any number of emission control signals that are controlled using a PWM scheme) may have a nominal pulse width PW at time T0 (i.e., when the display is still relatively new).

After some period of time and at time T1, the luminance of display 14 might have dropped by some amount due to the threshold voltage drift of oxide transistor T3 (as an example) or some other temporal aging effects. The amount of time between T0 and T1 might be at least 50 hours, at least 100 hours, 100 to 500 hours, more than 500 hours, or other suitable time period of operation during which display 14 might have suffered from undesirable changes in luminance. To mitigate the luminance drop, the pulse width of the emission control signals EM may be augmented by a pulse width offset amount ΔT such that the total pulse width is now increased to (PW+ΔT). Augmenting the pulse width of EM in this way increases the duty cycle, which boosts the degraded luminance back to its intended/original level at time T0.

After some period of time and at time T2, the luminance of display 14 might have degraded some more due to the threshold voltage drift of oxide transistor T3 (as an example) or some other temporal aging effects. The amount of time between T1 and T2 might be at least 50 hours, at least 100 hours, 100 to 500 hours, more than 500 hours, or other suitable time period of operation during which display 14 might have suffered from undesirable changes in luminance. To mitigate the luminance drop, the pulse width of the emission control signals EM may be further augmented by another pulse width offset amount ΔT such that the total pulse width is now increased to (PW+2*ΔT). Augmenting the pulse width of EM in this way further increases the duty cycle, which boosts the degraded luminance back to its intended/original level at time T0.

This process may continue indefinitely until the end of the life cycle of display 14. Note that at time TN, the total pulse width will have been augmented to (PW+N*ΔT). At some point (i.e., when duty cycle has been pushed to its limit of 100%), the duty cycle can no long be increased. Time TN should therefore corresponding to at least 2 years of normal operational use, 2-5 years or normal operational, 5-10 years of normal operational use, or more than 10 years of normal operational usage.

Figure 13B:
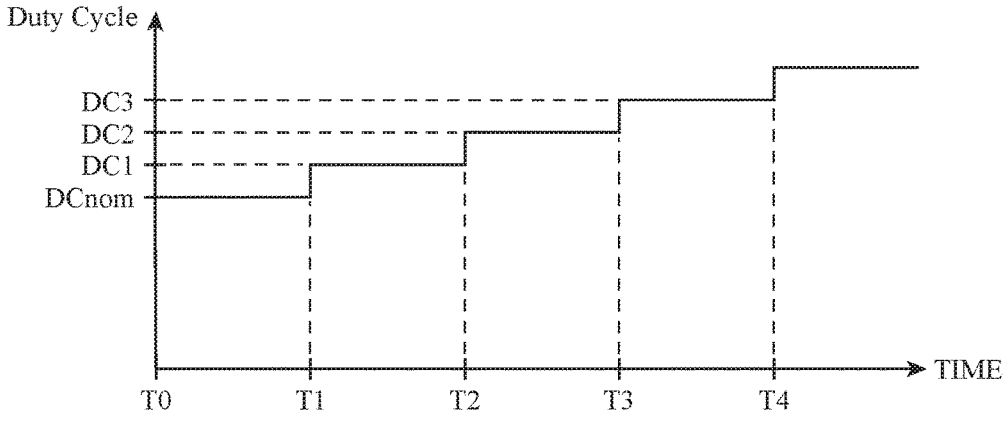
FIG. 13B is a plot showing how the duty cycle of emission signals can be adjusted over time in accordance with an embodiment.

FIG. 13B is a plot showing how the duty cycle of emission signals can be adjusted over time in accordance with an embodiment. As shown in FIG. 13B, at time T0, the pulse width of the emission control signals is at its nominal value and thus the duty cycle is set to a nominal duty cycle level DCnom. At time T1, the pulse width of the emission control signals is augmented by a first offset amount, which increases the duty cycle to DC1. At time T2, the pulse width of the emission control signals is augmented by a second offset amount, which increases the duty cycle to DC2. At time T3, the pulse width of the emission control signals is augmented by a third offset amount, which increases the duty cycle to DC3. This process may continue indefinitely until the PWM duty cycle is maxed out at 100%.

Figure 13C:
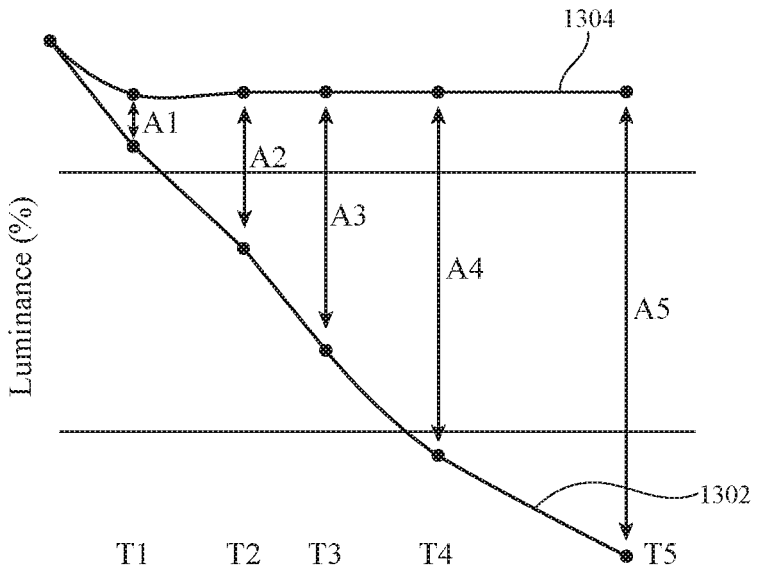
FIG. 13C is a diagram showing how the pulse width offset of emission signals can be increased over time at a first brightness setting in accordance with an embodiment.

FIG. 13C is a diagram showing the effect of EM signal pulse width offsets over time. Trace 1302 illustrates the percentage of luminance drop over time if pulse width was maintained at a fixed level (i.e., if duty cycle never changes). At time T1, a first amount of pulse width offset A1 may be applied to the nominal pulse width value PW, which would bring the luminance back up to a first corresponding point on trace 1304. At time T2, a second amount of cumulative pulse width offset A2 may be applied to the nominal pulse width value PW, which would push the luminance back up to a second corresponding point on trace 1304. At time T3, a third amount of cumulative pulse width offset A3 may be applied to the nominal pulse width value PW, which would push the luminance back up to a third corresponding point on trace 1304. At time T4, a fourth amount of cumulative pulse width offset A4 may be applied to the nominal pulse width value PW, which would push the luminance back up to a fourth corresponding point on trace 1304. This process may continue indefinitely until the duty cycle of EM has reached 100%.

Figure 13D:
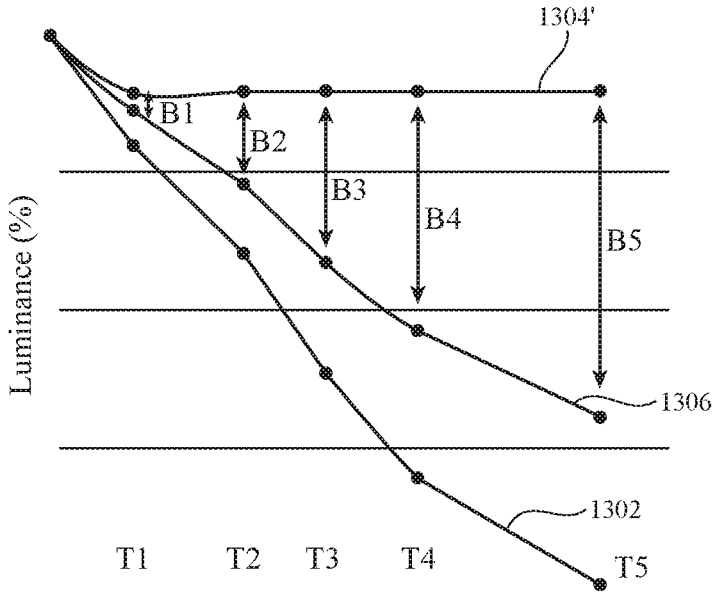
FIG. 13D is a diagram showing how the pulse width offset of emission signals can be increased over time at a second brightness setting in accordance with an embodiment.

The example of FIG. 13C may correspond to a first display luminance band (e.g., a first user-selected or externally-supplied brightness setting). In general, the pulse width offset amounts might vary at different display luminance bands (i.e., different display brightness settings may require different amounts of pulse width augmentation). Similar to FIG. 13C, trace 1302 of FIG. 13D illustrates the percentage of luminance drop over time if pulse width was maintained at a fixed level at the first luminance band. Trace 1306 in FIG. 13D illustrates the percentage of luminance drop over time if pulse width was maintained at a fixed level at a second luminance band with a higher luminance output than the first luminance band.

At time T1, a first amount of pulse width offset B1 may be applied to the nominal pulse width value PW, which would bring the luminance back up to a first corresponding point on trace 1304'. At time T2, a second amount of cumulative pulse width offset B2 may be applied to the nominal pulse width value PW, which would push the luminance back up to a second corresponding point on trace 1304'. At time T3, a third amount of cumulative pulse width offset B3 may be applied to the nominal pulse width value PW, which would push the luminance back up to a third corresponding point on trace 1304'. At time T4, a fourth amount of cumulative pulse width offset B4 may be applied to the nominal pulse width value PW, which would push the luminance back up to a fourth corresponding point on trace 1304'. This process may continue indefinitely until the duty cycle of EM has reached 100%.

Note that trace 1304' may be substantially similar to trace 1304. However, as illustrated in the juxtaposition between FIGS. 13C and 13D, the amount of EM pulse width offset is different at different brightness settings (i.e., A1 is not equal to B1, A2 is not equal to B2, A3 is not equal to B3, A4 is not equal to B4, A5 is not equal to B5, etc.). In other words, the PWM offset might be separately controlled for different brightness levels. If desired, the PWM offset amounts might be universally applied to all luminance bands to simplify the control of display 14 (i.e., a single PWM augmentation sequence is applied for all externally-supplied brightness settings).

In general, the method described in connection with FIGS. 13A-13D for maintaining display luminance may be applied to any suitable type of display (e.g., to OLED displays, to LCD displays, to plasma displays, or other types of displays) that uses a pulse width modulation scheme for controlling its brightness/luminance.

Figure 14A:
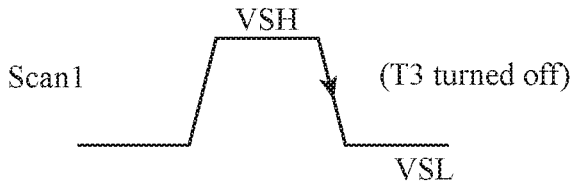
FIG. 14A is a diagram of an active-high scan control signal in accordance with an embodiment.

As described above in connection with FIG. 3B, the amount of OLED current and therefore display luminance is a function of charge injection and the source-drain rebalancing current that occurs as the problematic transistor such as oxide transistor T3 is being turned off. In the present embodiments, oxide transistor T3 is controlled by an active-high scan control signal (i.e., scan control signal Scan1 is driven high to turn on transistor T3 and driven low to turn off transistor T3). As shown in FIG. 14A, signal Scan1 may be deasserted or driven from positive voltage level VSH to negative voltage level VSL to turn off (among other transistors) transistor T3. In general, the amount of charge injected to gate node N2 (see, e.g., FIG. 3A) may be expressed as follows:

$$Q_{ch}=C_{ox}(\mathrm{VSH}-V_D-\mathrm{Vth_ox}) \tag{1}$$

Similarly, the amount of source-drain charge rebalancing current may be expressed as follows:

$$I_{12}=\frac{\mu_n C_{ox}}{2}*\frac{W}{L}[2(VSH-V_S-\mathrm{Vth_ox})*V_{DS}-V_{DS}^2] \tag{2}$$

As shown in the bolded portions of equations 1 and 2, both the charge injection amount $Q_{ch}$ and the rebalancing current level $I_{12}$ are at least partially proportional to the difference between VSH and Vth_ox. Assuming Vth_ox decreases over time (as shown in the example of FIG. 5A), a method to keep $Q_{ch}$ and $I_{12}$ constant would then involve reducing VSH at a similar pace as the drift in Vth_ox.

Figure 14B:
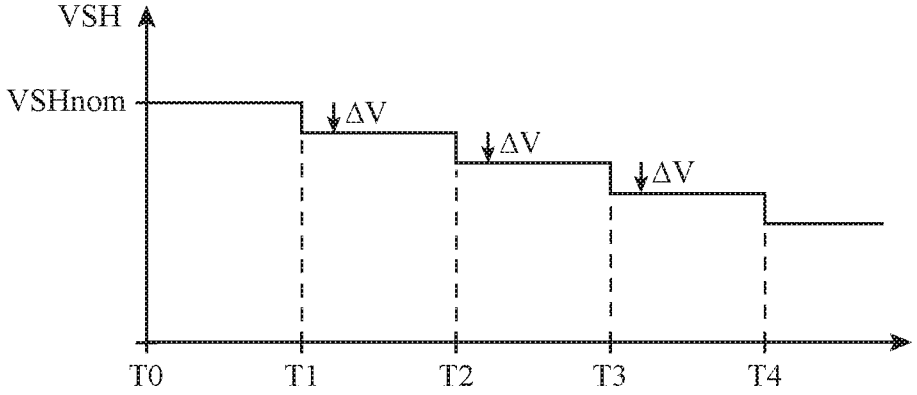
FIG. 14B is a timing diagram showing how the positive voltage level of the active-high scan control signal can be adjusted to mitigate display luminance drop in accordance with an embodiment.

FIG. 14B is a timing diagram showing how VSH of active-high scan control signal Scan1 can be adjusted to adapt to the changes in Vth_ox and thereby mitigate display luminance drop in accordance with an embodiment. At time T0 (i.e., when the display is still relatively new), VSH may be biased at a nominal positive power supply level VSHnom.

After some period of time and at time T1, the luminance of display 14 might have dropped by some amount due to the threshold voltage drift of oxide transistor T3. The amount of time between T0 and T1 might be at least 50 hours, at least 100 hours, 100 to 500 hours, more than 500 hours, or other suitable time period of operation during which display 14 might have suffered from undesirable changes in luminance. To mitigate the luminance drop, VSH might be reduced by a voltage offset amount ΔV to keep up with the change in Vth_ox. Offset amount ΔV might be 10 mV, 10-50 mV, 50-100 mV, or other suitable offset amount for adapting to the voltage drift in Vth_ox.

After some period of time and at time T2, the luminance of display 14 might have degraded some more due to further reductions in threshold voltage drift of oxide transistor T3. The amount of time between T1 and T2 might be at least 50 hours, at least 100 hours, 100 to 500 hours, more than 500 hours, or other suitable time period of operation during which display 14 might have suffered from undesirable changes in luminance. To mitigate the luminance drop, VSH might be further reduced by another voltage offset amount ΔV to keep up with the change in Vth_ox. This process may continue indefinitely until the end of the life cycle of display 14, lasting for least 2 years of normal operational use, 2-5 years or normal operational, 5-10 years of normal operational use, or more than 10 years of normal operational usage.

Figure 14C:
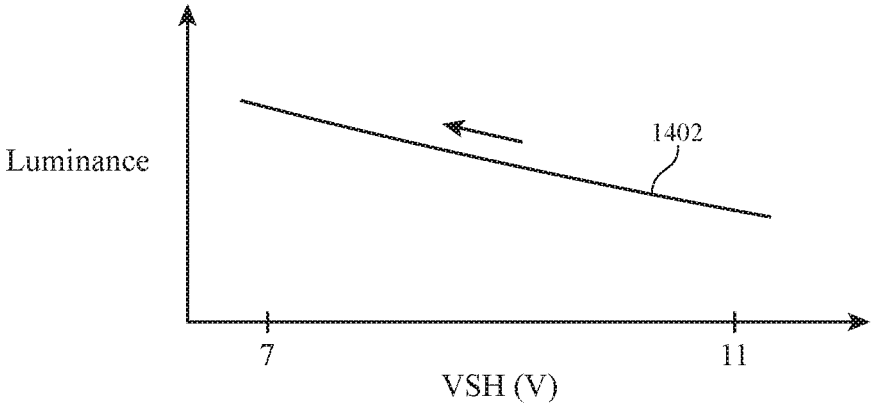
FIG. 14C is a plot showing how reducing the positive voltage level of the active-high scan control signal can help boost display luminance in accordance with an embodiment.

FIG. 14C is a plot showing how reducing VSH of scan control signal Scan1 can help boost the display luminance. As shown in curve 1402, reducing VSH in a linear or stepwise fashion over the lifetime of a display can help boost its luminance to compensate for undesired luminance drops caused by changes in Vth_ox. In general, the techniques shown in FIG. 14B and 14C may be applied to any display pixel having a transistor with a varying threshold voltage that might impact the luminance of the display.

Figure 15A:
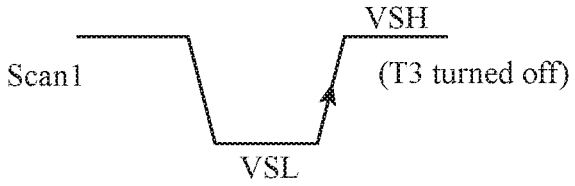
FIG. 15A is a diagram of an active-low scan control signal in accordance with an embodiment.

The examples above in which oxide transistor T3 is controlled by an active-high scan control signal is merely illustrative and is not intended to limit the scope of the present embodiments. In accordance with other suitable embodiments, oxide transistor T3 is a p-channel thin-film transistor that is controlled by an active-low scan control signal (i.e., scan control signal Scan1 is driven low to turn on transistor T3 and driven high to turn off transistor T3). As shown in FIG. 15A, signal Scan1 may be deasserted or driven from negative voltage level VSL to positive voltage level VSH to turn off (among other transistors) transistor T3. Equations 1 and 2 described above will also hold true for a p-channel transistor, except with the polarities switched. In other words, to keep $Q_{ch}$ and $I_{12}$ constant would involve actually increasing VSL at a similar pace as the drift in Vth_ox (assuming Vth_ox increases over time for a p-type transistor).

Figure 15B:
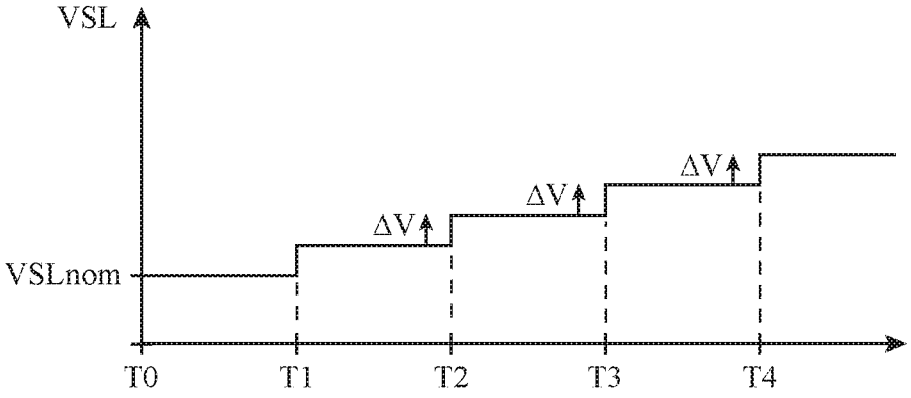
FIG. 15B is a timing diagram showing how the low voltage level of the active-low scan control signal can be adjusted to mitigate display luminance drop in accordance with an embodiment.

FIG. 15B is a timing diagram showing how VSL of active-low scan control signal Scan1 can be adjusted to adapt to the changes in Vth_ox and thereby mitigate display luminance drop in accordance with an embodiment. At time T0 (i.e., when the display is still relatively new), VSL may be biased at a nominal ground power supply level VSLnom.

After some period of time and at time T1, the luminance of display 14 might have dropped by some amount due to the threshold voltage drift of oxide transistor T3. The amount of time between T0 and T1 might be at least 50 hours, at least 100 hours, 100 to 500 hours, more than 500 hours, or other suitable time period of operation during which display 14 might have suffered from undesirable changes in luminance. To mitigate the luminance drop, VSL might be increased by a voltage offset amount ΔV to keep up with the change in Vth_ox. Offset amount ΔV might be 10 mV, 10-50 mV, 30-70 mV, 50-100 mV, or other suitable offset amount for adapting to the voltage drift in Vth_ox.

After some period of time and at time T2, the luminance of display 14 might have degraded some more due to further increases in threshold voltage drift of oxide transistor T3. The amount of time between T1 and T2 might be at least 50 hours, at least 100 hours, 100 to 500 hours, more than 500 hours, or other suitable time period of operation during which display 14 might have suffered from undesirable changes in luminance. To mitigate the luminance drop, VSL might be further increased by another voltage offset amount ΔV to keep up with the change in Vth_ox. This process may continue indefinitely until the end of the life cycle of display 14, lasting for least 2 years of normal operational use, 2-5 years or normal operational, 5-10 years of normal operational use, or more than 10 years of normal operational usage.

Figure 15C:
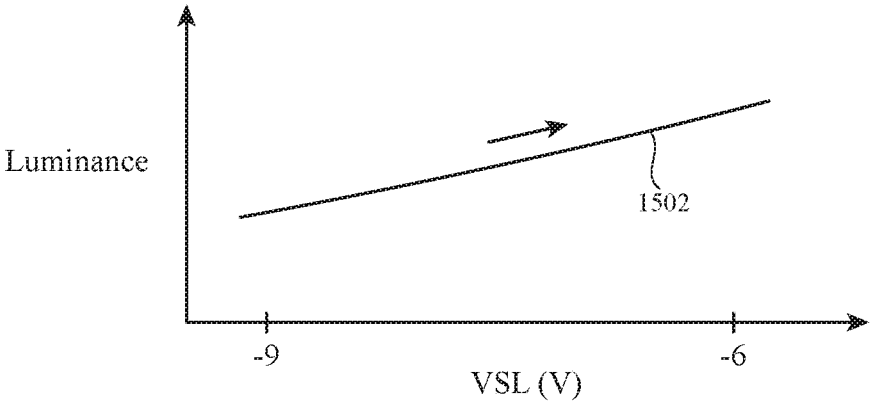
FIG. 15C is a plot showing how increasing the low voltage level of the active-low scan control signal can help boost display luminance in accordance with an embodiment.

FIG. 15C is a plot showing how raising VSL of scan control signal Scan1 can help boost the display luminance. As shown in curve 1502, escalating VSL in a linear or stepwise fashion over the lifetime of a display can help boost its luminance to compensate for undesired luminance drops caused by changes in Vth_ox. In general, the techniques shown in FIG. 15B and 15C may be applied to any display pixel having a transistor with a varying threshold voltage that might impact the luminance of the display.

The foregoing is merely illustrative and various modifications can be made to the described embodiments. The foregoing embodiments may be implemented individually or in any combination.

What is claimed is:

1. A display pixel, comprising:

a light-emitting diode;

a drive transistor coupled in series with the light-emitting diode, wherein the drive transistor comprises a drain terminal, a gate terminal, and a source terminal;

a transistor of a first semiconductor type coupled between the drain terminal and the gate terminal of the drive transistor, wherein the transistor of the first semiconductor type is configured to reduce leakage at the gate terminal of the drive transistor, and wherein the transistor of the first semiconductor type has a threshold voltage; and a transistor of a second semiconductor type different than the first semiconductor type, wherein the transistor of the second semiconductor type is interposed between transistor of the first semiconductor type and the gate terminal of the drive transistor, and wherein the transistor of the second semiconductor type is configured to reduce the sensitivity of an emission current that flows through the light-emitting diode to the threshold voltage of the transistor of the first semiconductor type.

2. The display pixel of claim 1, wherein the transistor of the first semiconductor type comprises a semiconducting-oxide thin-film transistor having a channel formed in semiconducting-oxide.

3. The display pixel of claim 2, wherein the transistor of the second semiconductor type comprises a silicon thin-film transistor having a channel formed in silicon.

4. The display pixel of claim 3, wherein the transistor of the first semiconductor type and the transistor of the second semiconductor type are both n-channel thin-film transistors.

5. The display pixel of claim 3, wherein the transistor of the first semiconductor type is an n-channel thin-film transistor, and wherein the transistor of the second semiconductor type is a p-channel thin-film transistor.

6. The display pixel of claim 3, further comprising:

a storage capacitor coupled to the gate terminal of the drive transistor, wherein the storage capacitor is configured to store a data signal for the display pixel; and a matching capacitor coupled to an intermediate node between the transistor of the first semiconductor type and the transistor of the second semiconductor type, wherein the matching capacitor is configured to reduce a rebalancing current that flows through the transistor of the first semiconductor type as the transistor of the first semiconductor type is turned off.

7. The display pixel of claim 6, wherein the matching capacitor is smaller than the storage capacitor.

8. The display pixel of claim 3, further comprising:

a storage capacitor coupled to the gate terminal of the drive transistor, wherein the storage capacitor is configured to store a data signal for the display pixel; and a matching capacitor coupled to the drain terminal of the drive transistor, wherein the matching capacitor is configured to reduce a rebalancing current that flows through the transistor of the first semiconductor type as the transistor of the first semiconductor type is turned off.

9. The display pixel of claim 3, wherein the transistor of the first semiconductor type has a gate terminal configured to receive a scan control signal, and wherein the transistor of the second semiconductor type has a gate terminal configured to receive an emission control signal that is different than the scan control signal.

10. The display pixel of claim 3, wherein the transistor of the first semiconductor type and the transistor of the second semiconductor type have gate terminals configured to receive the same scan control signal.

11. The display pixel of claim 10, wherein the transistor of the first semiconductor type has a first threshold voltage, and wherein the transistor of the second semiconductor type has a second threshold voltage that is greater than the first threshold voltage.

12. The display pixel of claim 3, further comprising:

a first emission transistor coupled in series with the drive transistor and the light-emitting diode;

a second emission transistor coupled in series with the drive transistor and the light-emitting diode;

an initialization transistor coupled directly to the light-emitting diode; and a data loading transistor coupled directly to the source terminal of the drive transistor.

13. A method of operating a display pixel, comprising:

during an emission phase, using a drive transistor in the display pixel to convey an emission current to a light-emitting diode in the display pixel, wherein the drive transistor comprises a drain terminal and a gate terminal;

using a transistor of a first semiconductor type coupled between the drain terminal and the gate terminal of the drive transistor to reduce leakage at the gate terminal of the drive transistor during the emission phase, wherein the transistor of the first semiconductor type has a threshold voltage; and using a transistor of a second semiconductor type interposed between the transistor of the first semiconductor type and the gate terminal of the drive transistor to reduce the sensitivity of the emission current to the threshold voltage of the transistor of the first semiconductor type.

14. The method of claim 13, wherein the transistor of the first semiconductor type comprises a semiconducting-oxide thin-film transistor, and wherein the transistor of the second semiconductor type comprises a silicon thin-film transistor.

15. The method of claim 14, further comprising:

providing a scan control signal to a gate terminal of the transistor of the first semiconductor type;

providing an emission control signal that is different than the scan control signal to a gate terminal of the transistor of the second semiconductor type; and deasserting the emission control signal before a falling edge of the scan control signal and asserting the emission control signal after the falling edge of the scan control signal.

16. The method of claim 14, further comprising:

providing a scan control signal to a gate terminal of the transistor of the first semiconductor type;

providing the scan control signal to a gate terminal of the transistor of the second semiconductor type; and turning off the transistor of the second semiconductor type before turning off the transistor of the first semiconductor type at a falling edge of the scan control signal.

17. An electronic device, comprising:

a display having an array of display pixels, wherein each display pixel in the array of display pixels comprises:

a light-emitting diode;

a drive transistor coupled in series with the light-emitting diode, wherein the drive transistor comprises a drain terminal, a gate terminal, and a source terminal;

a semiconducting-oxide transistor coupled between the drain terminal and the gate terminal of the drive transistor; and a silicon transistor coupled between the semiconducting-oxide transistor and the gate terminal of the drive transistor.

18. The electronic device of claim 17, wherein each display pixel in the array of display pixels further comprises:

a storage capacitor directly coupled to the gate terminal of the drive transistor; and a matching capacitor directly coupled to the semiconducting-oxide transistor, wherein the matching capacitor is configured to reduce a rebalancing current that flows through the semiconducting-oxide transistor.

19. The electronic device of claim 18, wherein the matching capacitor is substantially smaller than the storage capacitor.

20. The electronic device of claim 19, wherein each display pixel in the array of display pixels further comprises:

a first emission transistor coupled in series with the drive transistor and the light-emitting diode;

a second emission transistor coupled in series with the drive transistor and the light-emitting diode;

an initialization transistor coupled directly to the light-emitting diode; and a data loading transistor coupled directly to the source terminal of the drive transistor.

21. The electronic device of claim 20, further comprising:

a first scan line driver circuit configured to output a first scan control signal to a gate terminal of the semiconducting-oxide transistor and a gate terminal of the initialization transistor;

a second scan line driver circuit configured to output a second scan control signal to a gate terminal of the data loading transistor;

a first emission line driver circuit configured to output a first emission control signal to a gate terminal of the first emission transistor;

a second emission line driver circuit configured to output a second emission control signal to a gate terminal of the second emission transistor; and a third emission line driver circuit configured to output a third emission control signal to a gate terminal of the silicon transistor, wherein the third emission line driver circuit is configured to receive the first scan control signal from the first scan line driver circuit and to receive the second scan control signal from the second scan line driver circuit.

22. The electronic device of claim 21, wherein the first emission line driver circuit is configured to receive a first pair of clock signals, wherein the second emission line driver is configured to receive a second pair of clock signals, and wherein the third emission line driver circuit is further configured to receive a selected one of the first pair of clock signals associated with the first emission line driver circuit and the second pair of clock signals associated with the second emission line driver circuit.

23. The electronic device of claim 22, wherein the third emission line driver circuit comprises:

a pull-up transistor;

a pull-down transistor connected in series with the pull-up transistor; and a first transistor having a gate terminal configured to receive a first clock signal in the selected pair of clock signals;

a second transistor having a gate terminal configured to receive the first scan control signal;

a third transistor having a gate terminal configured to receive the second scan control signal, wherein the first, second, and third transistors are used to simultaneously turn on the pull-down transistor; and a fourth transistor having a gate terminal configured to receive the second clock signal in the selected pair of clock signals, wherein the fourth transistor is used to turn off the pull-down transistor.

24. The electronic device of claim 23, wherein the third emission line driver circuit further comprises:

a fifth transistor having a gate terminal configured to receive the second clock signal in the selected pair of clock signals, wherein the fifth transistor is used to turn on the pull-up transistor;

a sixth transistor having a gate terminal configured to receive a fixed power supply voltage; and a seventh transistor having a gate terminal configured to receive the first scan control signal, wherein the sixth and seventh transistors are used to simultaneously turn off the pull-up transistor.

25. The electronic device of claim 23, wherein the third emission line driver circuit further comprises:

a second stage configured to receive the first scan control signal and signals from the first stage, wherein the second stage has an output directly connected to a gate terminal of the pull-up transistor, and wherein there is no discrete capacitor coupled to the gate terminal of the pull-up transistor.

26. The electronic device of claim 21, wherein the third emission line driver circuit does not receive a start pulse signal.

* * * * *